US011178914B2

(12) United States Patent
Brown et al.

(10) Patent No.: US 11,178,914 B2
(45) Date of Patent: Nov. 23, 2021

(54) VAPING LIQUID DISPENSING AND VENDING

(71) Applicant: Revolutionary Electronic Design, LLC, Greensburg, PA (US)

(72) Inventors: Joshua Thomas Brown, Greensburg, PA (US); Thomas Robert Young, II, Schellsburg, PA (US); Robert Czarnek, Johnstown, PA (US)

(73) Assignee: Revolutionary Electronic Design, LLC, Greensburg, PA (US)

( * ) Notice: Subject to any disclaimer, the term of this patent is extended or adjusted under 35 U.S.C. 154(b) by 593 days.

(21) Appl. No.: 14/720,766

(22) Filed: May 23, 2015

(65) Prior Publication Data

US 2015/0336689 A1 Nov. 26, 2015

Related U.S. Application Data

(60) Provisional application No. 62/002,205, filed on May 23, 2014.

(51) Int. Cl.
*B65B 3/12* (2006.01)
*B65B 3/30* (2006.01)
(Continued)

(52) U.S. Cl.
CPC ..... *A24F 47/00* (2013.01); *B65B 3/04* (2013.01); *B65B 3/12* (2013.01); *B65B 3/30* (2013.01); *B65B 3/326* (2013.01); *G07F 13/06* (2013.01); *B01F 15/0243* (2013.01); *B01F 15/0244* (2013.01); *B01F 15/0245* (2013.01); *B01F 15/0246* (2013.01); *B01F 15/0247* (2013.01); *B01F 15/0248* (2013.01); *B65B 37/06* (2013.01)

(58) Field of Classification Search
CPC ..... G07F 13/06; A24F 47/00; A24F 47/008; B01F 15/0243; B01F 15/0244; B01F 15/0245; B01F 15/0246; B01F 15/0247; B01F 15/0248; B65B 3/12; B65B 3/30; B65B 3/04; B65B 3/326; B65B 37/06
USPC .... 53/55, 64, 111 R, 135.1, 136.1, 167, 281; 141/18, 98, 100, 104, 192; 700/242
See application file for complete search history.

(56) References Cited

U.S. PATENT DOCUMENTS 6,053,359 A * 4/2000 Goulet ..... G07F 13/10 221/221
6,283,174 B1 * 9/2001 Sperry ..... B31D 5/0078 141/85
(Continued)

*Primary Examiner* — Hemant Desai
*Assistant Examiner* — Mobeen Ahmed
(74) *Attorney, Agent, or Firm* — GTC Law Group PC & Affiliates

(57) ABSTRACT

A vaping liquid dispensing and vending apparatus comprises filling module(s), user container holder(s), positioning mechanism(s) and controller module(s). The filling module(s) comprise: machine container(s) configured to hold vaping liquid(s), nozzle(s) configured to dispense vaping liquid(s) to user container(s), and measuring pump module(s) configured to pump a measured amount of vaping liquid(s) from machine container(s) to nozzle(s). The user container holder(s) are configured to hold user container(s). Positioning mechanism(s) align user container holder(s) with filing module(s). Controller module(s) execute production instructions causing vaping liquid formulations to be dispensed into user container(s).

32 Claims, 19 Drawing Sheets

(51) Int. Cl.

| | |
|---|---|
| ***A24F 47/00*** | (2020.01) |
| ***G07F 13/06*** | (2006.01) |
| ***B65B 3/04*** | (2006.01) |
| ***B65B 3/32*** | (2006.01) |
| *B01F 15/02* | (2006.01) |
| *B65B 37/06* | (2006.01) |

(56) References Cited

U.S. PATENT DOCUMENTS 6,793,387 B1 * 9/2004 Neas ..... B01F 13/1058 141/104
7,577,498 B2 * 8/2009 Jennings ..... B25J 9/0084 141/100
7,757,896 B2 * 7/2010 Carpenter ..... G07F 13/065 222/129.4
7,913,879 B2 * 3/2011 Carpenter ..... B67D 1/0085 222/129.4
8,340,815 B2 * 12/2012 Peters ..... G07F 9/002 700/236
8,386,072 B1 * 2/2013 Mihalik ..... B01F 5/0615 700/233
8,794,275 B2 * 8/2014 Gruber ..... B67C 3/22 141/144
9,141,562 B2 * 9/2015 Pickett ..... B65B 7/2807
10,043,226 B2 * 8/2018 Craparo ..... G06Q 50/12
10,440,989 B2 * 10/2019 Gardella ..... B65B 3/003
10,583,949 B1 * 3/2020 Ellis ..... B65B 39/12
2005/0150191 A1 * 7/2005 Taylor ..... B65B 3/34 53/471
2006/0081653 A1 * 4/2006 Boland ..... G16H 50/30 222/243
2009/0038270 A1 * 2/2009 Mahon ..... B29B 7/7689 53/469
2009/0158937 A1 * 6/2009 Stearns ..... A47J 31/41 99/280
2010/0030355 A1 * 2/2010 Insolia ..... G06Q 30/0603 700/97
2011/0005958 A1 * 1/2011 Stepovich ..... G05D 21/02 206/524.1
2011/0265806 A1 * 11/2011 Alarcon ..... A24F 47/008 131/273
2011/0313358 A1 * 12/2011 Hariharesan ..... A61M 5/14228 604/151
2012/0050394 A1 * 3/2012 Takada ..... B41J 2/16585 347/27
2012/0330781 A1 * 12/2012 Borrero ..... G06Q 30/00 705/26.8
2013/0042575 A1 * 2/2013 Hayashi ..... B41J 2/2114 53/268
2013/0087050 A1 * 4/2013 Studor ..... A47J 31/52 99/285
2013/0090759 A1 * 4/2013 Fleishman ..... G07F 11/28 700/236
2013/0158704 A1 * 6/2013 Hughes ..... B08B 3/02 700/239
2013/0177455 A1 * 7/2013 Kamen ..... F04B 43/12 417/313
2013/0240079 A1 * 9/2013 Petrini ..... B67D 1/0003 141/1
2013/0240084 A1 * 9/2013 Carter ..... B67D 1/0004 141/94
2013/0297066 A1 * 11/2013 Alvern ..... G07F 9/023 700/232
2013/0338821 A1 * 12/2013 Igarashi ..... B67D 7/08 700/233
2013/0340775 A1 * 12/2013 Juster ..... H04L 67/42 131/273
2014/0114469 A1 * 4/2014 Givens ..... B67D 1/0041 700/232
2015/0191266 A1 * 7/2015 Holmes ..... B65B 43/50 141/86
2015/0327596 A1 * 11/2015 Alarcon ..... A24F 47/008 131/328
2016/0200463 A1 * 7/2016 Hodges ..... G07F 13/02 53/415
2017/0046904 A1 * 2/2017 Studor ..... B67D 3/0003
2017/0215631 A1 * 8/2017 Studor ..... A47J 31/4403
2018/0215488 A1 * 8/2018 Sebastian ..... B65D 50/04

* cited by examiner

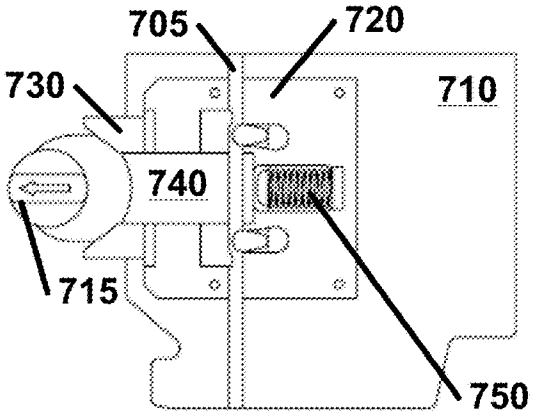
FIG. 8A
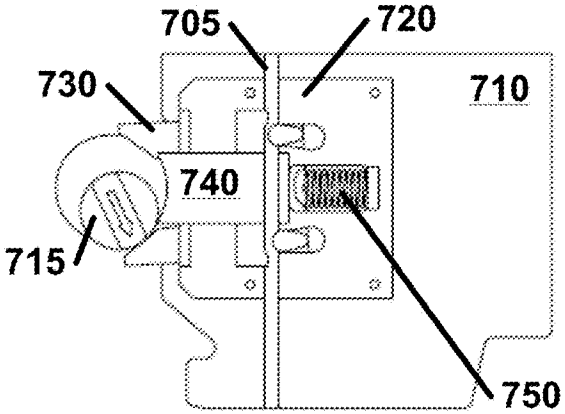
FIG. 8B
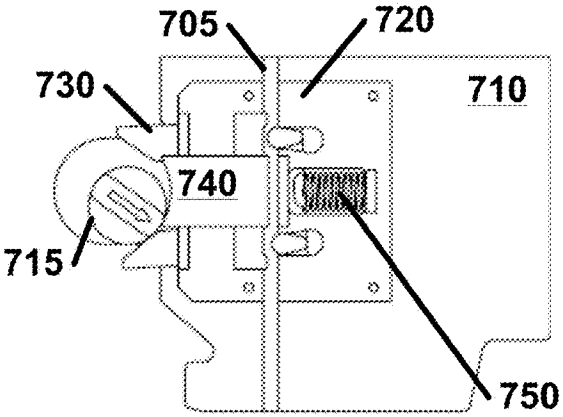
FIG. 8C
FIG. 8D
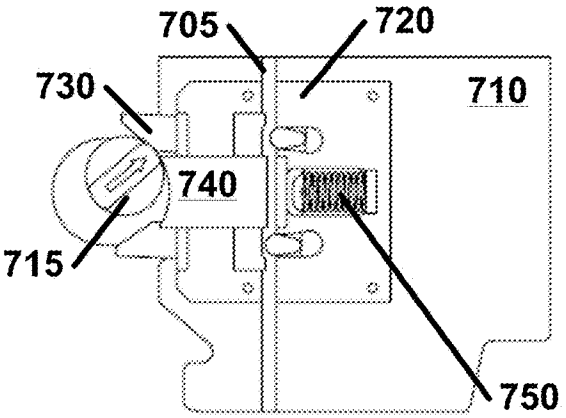
FIG. 8E
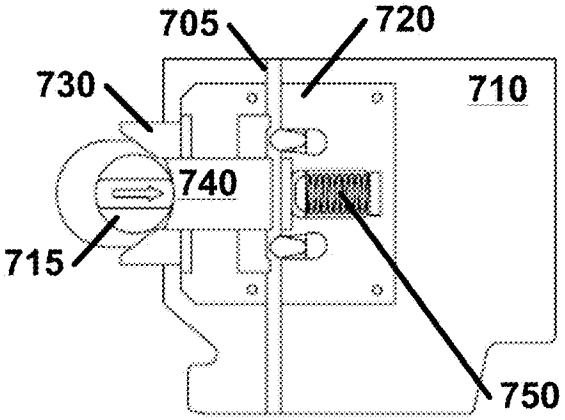
FIG. 8F

VAPING LIQUID DISPENSING AND VENDING

BRIEF DESCRIPTION OF THE SEVERAL VIEWS OF THE DRAWINGS

Example

Example

Example

Example

Example

Example

Example

Example

Example

Example FIGS. 8A through 8F illustrate a sequence of six pumping stages within a single pumping cycle as per aspects of an embodiment of the present invention.

Example

Example

Example

Example

Example

Example

Example

Example

Example

Example

Example

DETAILED DESCRIPTION OF EMBODIMENTS

Embodiments of the present invention dispense vaping liquids into containers. A vaping liquid is a liquid solution compatible with various vaporizers, such as for example, a personal vaporizer. A personal vaporizer is a small powered vaporizer. Some powered vaporizers are powered by one or more batteries. Some personal vaporizers are configured to provide a user with a similar experience to smoking tobacco from, for example, a cigarette, a cigar, a pipe, and/or the like. As such, some of the various personal vaporizers may be shaped to simulate a device and/or product such as a cigarette, a cigar, a pipe, and/or the like. For example, personal vaporizers may be shaped in a cylindrical from to simulate a cigarette. A user of a personal vaporizer may inhale an aerosol, commonly called vapor, rather than cigarette smoke. Some personal vaporizers may comprise a heating element that atomizes the vaping liquid. The vapor may comprise ultrafine particles that themselves comprise ingredients from the vaping liquid. Some vaping liquids are known as e-liquid. Some of the various personal vaporizers may be disposable or reusable.

Figure 1:
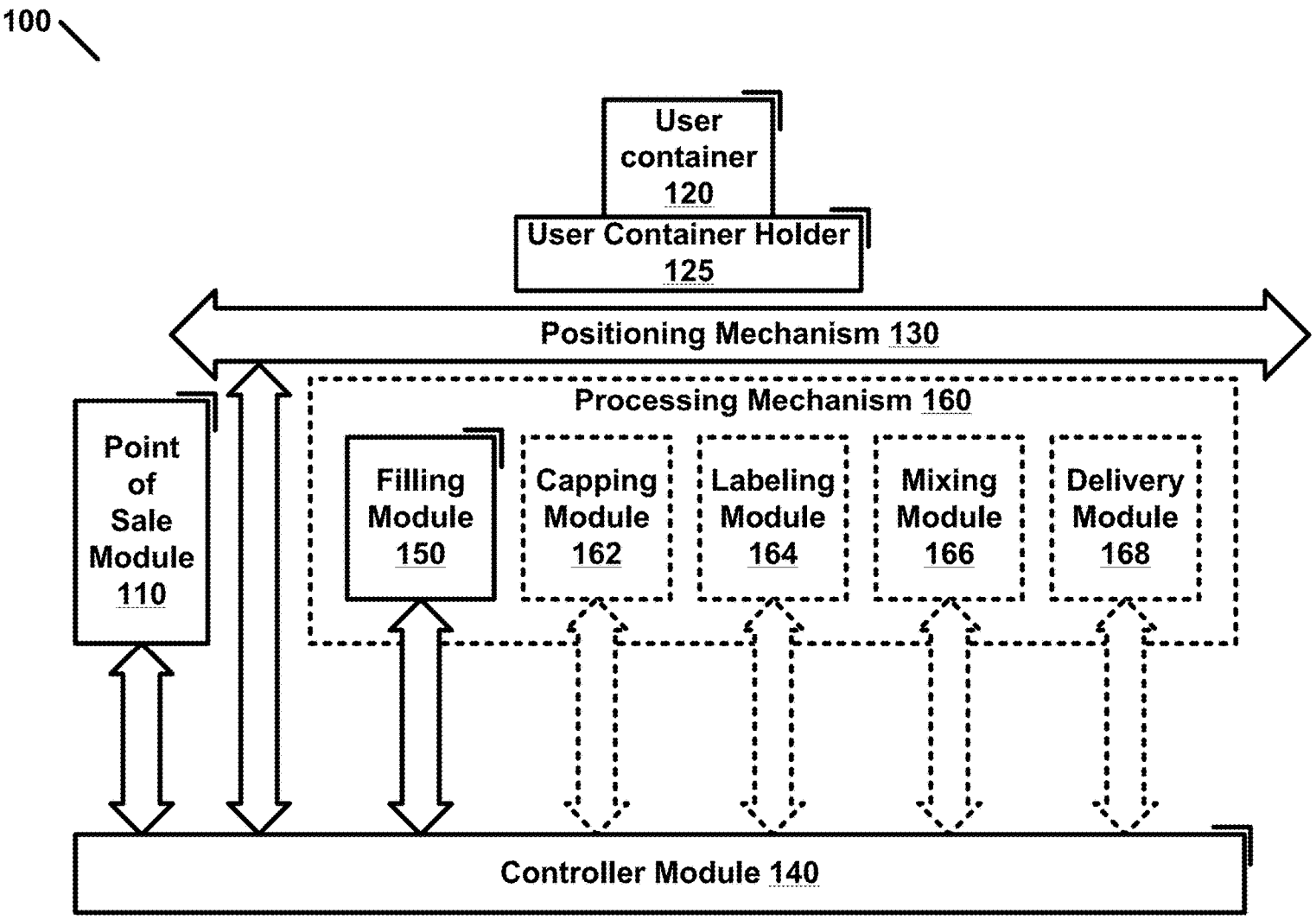
FIG. 1 is a block diagram of a vaping liquid dispensing apparatus as per some of the aspects of various embodiments of the present invention.

Example FIG. 1 is a block diagram of a vaping liquid dispensing apparatus 100 as per some of the various embodiments. According to some of the various embodiments, the apparatus may comprise at least one filling module 150, at least one user container holder 125, a positioning mechanism 130, and a controller module 140. A user or operator may, according to some of the various embodiments, provide the vaping liquid dispensing apparatus 100 with dispensing instructions via an input module such as, for example, point of sale module 110. A controller 140 may interact with a series of devices (e.g. positioning mechanism 130, filing module 150, capping module 162, labeling module 164, mixing module 166, delivery module 168, combinations thereof and/or the like) through communications, actuators, sensors, combinations thereof, and/or the like to dispense vaping liquid into user container(s) 120. A user container 120 may be disposed in user container holder 125. Positioning mechanism 130 may align the user container holder 125 to various processing mechanism(s) 160 (e.g. filing module 150, capping module 162, labeling module 164, mixing module 166, delivery module 168, combinations thereof and/or the like). For example, positioning mechanism 130 may align user container 120 (via user container holder 125) with a filing module 150. The filing module 150 may dispense a measured amount of vaping liquid into user container 120. User container 120 may also be aligned with one or more of the following: capping module 162 to seal the user container 120, labeling module 162 to apply labeling information to user container 120, mixing module 166 to mix the contents of user container 120, delivery module 168 to remove the user container from the vaping liquid dispensing apparatus 100, combinations thereof, and/or the like.

Figure 2:
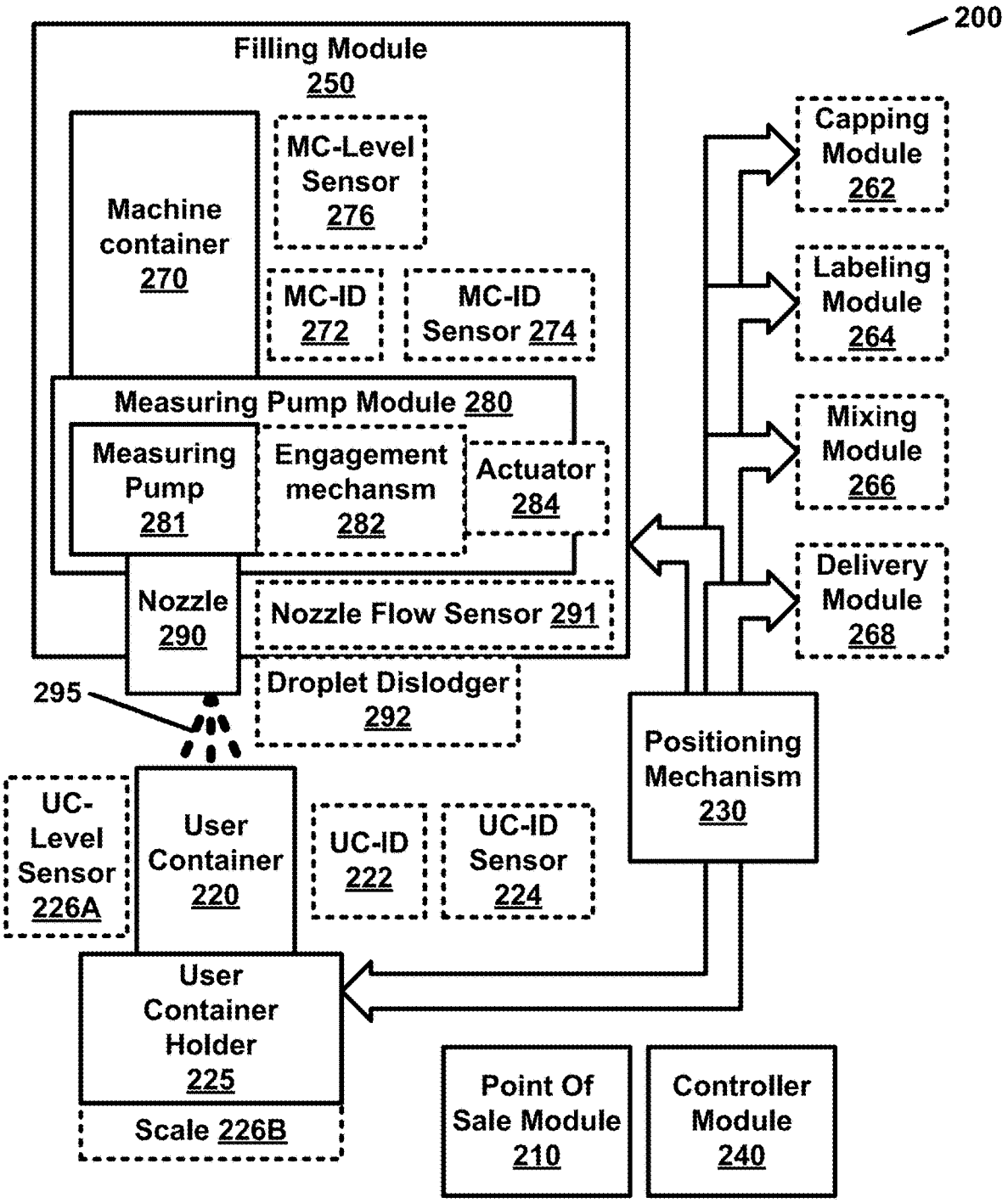
FIG. 2 is a block diagram of a vaping liquid dispensing apparatus 200 as per some of the aspects of various embodiments of the present invention.

FIG. 2 is a block diagram of an example vaping liquid dispensing apparatus 200 as per aspects of some of the various embodiments. According to some of the various embodiments, the vaping liquid dispensing apparatus 200 may comprise, but is not limited to: at least one filling module 250, at least one user container holder 225, a positioning mechanism 230, and a controller module 240.

According to some of the various embodiments, the filling module 250 may comprise a machine container 270, a nozzle 290, and a measuring pump module 280. The filling module 250 may be configured to deliver a measured amount of vaping liquid to a user container. The filling module 250 may be replaceable to ease in maintenance of the vaping liquid dispensing apparatus 200. In alternative embodiments, filling module 250 may be mounted in a more permanent position. However, in such an embodiment, parts of the filing module 250 may be configured to be replaceable. For example, a filling module 250 may be configured such that machine container 270, measuring pump module, nozzle 290, components and/or parts of one or more of the above, and/or the like are replaceable. The term replaceable, may refer to one or more of, replaceable, consumable, disposable, recyclable, refurbishable, combinations thereof, and/or the like.

According to some of the various embodiments, the machine container 270 may be configured to hold at least one of a multitude of vaping liquids. Vaping liquids may comprise one or more of the following: propylene glycol, glycerin, water, nicotine, various flavorings, a combination of the above, and/or the like. The machine container 270 may comprise at least one of the following: a bag, a bottle, a box, a jar, a combination of the above, and/or the like. The machine container 270 may be configured to be replaceable. In other words, the machine container 270 has physical attributes, such as latches, hangers, hooks, combinations thereof, and/or the like that enable the machine container 270 to be removed, refilled and/or replaced from the filing module 250.

According to some of the various embodiments, the machine container 270 may comprise an outlet tube configured to be thread through the measuring pump module 280. The outlet tube may be elastomeric to maintain a circular cross section after multiple cycles of squeezing by a measuring pump. Example elastomers for pump tubing comprise nitrile (NBR), Hypalon, Viton, silicone, PVC, EPDM, EPDM+polypropylene (as in Santoprene), polyurethane and natural rubber. Each of these materials may comprise characteristics that may make them suitable for various combinations of vaping liquid(s) and pumps. For example, natural rubber may comprise suitable fatigue resistance for a pump, and EPDM and Hypalon may comprise good chemical compatibility with various vaping liquids. Silicone may be employed with water-based fluids.

Some tubing may be lined tubing. Lined tubing may, for example, comprise a thin inside liner made of a chemically resistant material such as poly-olefin and PTFE that may form a barrier for the rest of the tubing wall from coming in contact with the pumped fluid. These liners may not be as elastomeric as the outer tubing, which may be more suitable for pumping. Tubing may be selected to provide adequate chemical compatibility and life when employed to transport vaping liquids. Some tubing, such as fluoroelastomer tubing, the elastomer itself may comprise a chemical resistance to vaping liquids.

According to some of the various embodiments, nozzle 290 may be configured to dispense at least one of the multitude of vaping liquids to at least one user container 220. The nozzle 290 may be configured to control the direction and/or characteristics of the flow (e.g. adjust velocity) of vaping liquids dispensed from the machine container 270 to the user container 220 via the measuring pump 280. The nozzle 290 may comprise a pipe or tube of varying cross sectional area, and may be employed to direct or modify the flow of the vaping liquid. Some of the characteristics that the nozzle 290 may be configured to control may comprise, but not limited to: rate of flow, speed, direction, mass, shape, and/or the pressure of the stream. In nozzle 290, the velocity of the vaping liquid may be increased at the expense of the emerging vaping fluid pressure.

According to some of the various embodiments, nozzle 290 may be disposed at the end of an outlet tube connected to machine container 270 and configured to be thread through pumping module 280. Nozzle 290 may be configured to allow the tube end to be fit into a nozzle inlet. In such a case, the nozzle may be configured as part of the filing module 250. In yet other embodiments, nozzle 290 may fit on the end of the outlet tube and placed into a nozzle holder of the filling module 250. In this type of embodiment, the nozzle 290 may be replaced in the filling module with each change of the machine container.

According to some of the various embodiments, a droplet dislodger 292 may be mounted proximate to the nozzle 290 outlet. The droplet dislodger 292 may be configured to dislodge droplets from the nozzle 290 using a mechanism such as, but not limited to: air, electrostatic forces, a vacuum, a blower, a shaker, a vibrator a pulse (e.g. formed by a hammer hitting the tubing to generate a pressure pulse to dislodge the droplets from the nozzle), a combination thereof, and/or the like.

According to some of the various embodiments, measuring pump module 280 may be configured to pump a measured amount of at least one of the multitude of vaping liquids from the machine container 270 to the nozzle 290. The measuring pump module 280 may be configured to pump vaping liquids in increments of 10 to 100 microliters (e.g. increments of 50 microliters). This is different than many pumps that are configured to pump much larger quantities of liquids that may be pumped in a relatively large stream. According to some of the various embodiments, pumping module 280 may dispense vaping liquids in quantities that comprise drops. For example, where streaming pump may dispense liquid in incremental quantities of ounces, the present embodiments need to solve a problem of pumping vaping liquids in microliter increments to fulfill orders that may comprise milliliters. So for example, one of a multitude of measuring pump module(s) 180 may be employed by a vaping liquid dispensing apparatus 200 to create a formulation, for example, of approximately 15 milliliters of vaping liquid solution in a user container. Each of the multitude of measuring pump module(s) 180 may provide a part of the mixture pumped into the user container 220 in increments, for example, 10 to 100 microliters.

Each measuring pump module 280 may comprise a measuring pump 281 configured to pump the vaping liquid. The measuring pump may comprise, for example, at least one of the following types of pumps: a peristaltic pump, a syringe pump, a valve pump, a piston pump, a diaphragm pump, a positive displacement pump, a gear pump, a combination of the above, and/or the like. As discussed above, the pump may need to be configured to pump the vaping liquid in incremental measured amounts, for example, of 10 to 100 microliters.

A peristaltic pump is a type of positive displacement pump employed for pumping a variety of fluids. The fluid may be contained within a flexible tube fitted inside a pump casing. The pump casing may be circular. Alternatively, the pump casing may be linear and/or other shape that still employs a peristaltic pumping mechanism. For example, a rotor with a number of rollers, shoes, wipers, lobes, fingers, combinations thereof, and/or the like may be attached to an external circumference of a rotor compressing the flexible tube. As the rotor moves, the part of the tube under compression may be pinched closed (or "occludes") thus forcing fluid to be pumped to move through the tube. Additionally, as the tube opens to its natural state after the passing of the pressing mechanism, "restitution" or "resilience" fluid flow may be induced to the pump. This process may be referred to as peristalsis. Typically, there may be two or more pressing mechanisms occluding the tube, trapping between them a body of fluid. The body of fluid may be transported, at ambient pressure, toward the pump outlet. According to some of the various embodiments, a peristaltic pump may be indexed through full and/or partial revolutions to deliver smaller amounts of vaping fluid.

It is envisioned that other types of measuring pumps 281 may be employed in a measuring pump module 280. For example, a syringe pump may be employed to deliver vaping liquids in measured quantities. A syringe pump (or driver) may comprise a small infusion pump employed to pump small amounts of fluid. Basically, a drive may push the piston of a syringe to deliver a precise amount of flow through an exit opening without pulsation.

According to some of the various embodiments, measuring pump module 280 may comprise an engagement mechanism 282 configured to connect the measuring pump 281 to an external actuator 284. The external actuator may be a controllable actuator device configured to cause a controllable motion. A linear actuator may cause a linear motion whereas a rotating actuator may cause an angular motion. The actuator 284 may interface with the measuring pump 281 to drive the measuring pump 281. Examples of actuator(s) 284 comprise a motor, a pneumatic drive, a hydraulic drive, an electromagnetic drive, a linear motor, a linear actuator, a cam, a motor, a solenoid, combinations thereof, and/or the like. The engagement mechanism 282 may comprise a clutch mechanism that engages and disengages a mechanical motion between the measuring pump 280 and the actuator 284. The engagement mechanism 282 may operate within a control system where controller 240 commands the actuation. The commands from controller 240 may be part of a closed loop where the measurements of delivered vaping liquid are measured via a sensor.

According to some of the various embodiments, measuring pump module 280 may be integrated with the machine container 270. For example, a loaded syringe pump may comprise machine container 270 and measuring pump 280. In such an embodiment, the integrated machine container 270 and measuring pump 280 may be replaced together whenever machine container 270 runs out of a vaping liquid. Alternatively, the integrated machine container 270 and measuring pump 280 may be refilled whenever machine container 270 runs out of a vaping liquid.

According to some of the various embodiments, the measuring pump module 280 may comprise a support structure. The support structure may be configured to hold at least the machine container 270 and the measuring pump 281. The support structure may further comprise a hanger configured to support the machine container 270. Additionally, the measuring pump module 280 may comprise a handle disposed on the support structure and configured to support the weight of the measuring pump module 281 and the machine container 270 when filled with at least one of the multitude of vaping liquids.

According to some of the various embodiments, sensors may be employed to identify various machine container(s) 270 and associated vaping liquid levels. For example, a machine container sensor 274 may be employed to read a machine readable machine container identifier 272 that may be located proximate to machine container 270. The machine container sensor 274 may be communicatively connected to controller module 240. The machine readable machine container identifier 272 may be employed to identify the type of vaping liquid stored in machine container 270. The machine readable machine container identifier 272 may comprise one or more of the following: a bar code, an RFID (Radio Frequency Identifier), a near-field communication (NFC) device, combinations thereof and/or the like. The machine container sensor 274 may be a device that is compatible with the machine readable machine container identifier 272. So for example, if the machine readable machine container identifier 272 is a bar code, the machine container sensor 274 may comprise a bar code reader.

According to some of the various embodiments, the vaping liquid dispensing apparatus 200 may comprise at least one user container holder 225 configured to hold at least one user container 220. User container(s) 220 may be at least one of the following: an e-cigarette, a personal vaporizer, a vaping liquid tank, a bottle configured to fill one of the above, a combination of the above, and/or the like. The user container holder 225 may be configured to be stationary or movable. A moveable user container holder 225 may be configured to move linearly, rotationally, a combination thereof, and/or the like. The movement may be implemented to allow user container(s) 220 to be aligned with various processing modules (e.g. filling module 250).

According to some of the various embodiments, the alignment between user container holder(s) 225 (and associated user container(s) 220) with various processing modules (e.g. filling module 250) may be achieved by employing a positioning mechanism 230. The positioning mechanism 230 may comprises at least one of the following: a rotary positioning mechanism, a robotic manipulating mechanism, a linear positioning mechanism, a multilevel positioning mechanism, a combination thereof, and/or the like. In embodiments where there are processing modules on various levels (e.g. embodiments with stacked carousels), the positioning mechanism 230 may employ three dimensional travel elements. So for example, vaping liquid dispensing apparatus 200 embodiments that incorporate a multilevel carousel, positioning mechanism 230 may be configured to move user container holder(s) 225 rotationally around the carousel and up and down between carousel levels. This may employ both rotational and linear movement. Additionally, if there are processing modules that reside outside the carousel, positioning mechanism 230 may employ a movement device such as a linear actuator to move user container holder(s) 225 from the carousel to the other processing modules.

According to some of the various embodiments, positioning mechanism 230 may be configured to move at least one of the following: user container holder(s) 225, filing module(s) 250, at least one user container 220, at least one dispensing mechanism, a combination of the above, and/or the like. Positioning mechanism(s) 230 may comprise actuator(s) configured to be controllable by the controller module 240. An example of such an actuator may comprise a motor, a pneumatic drive, a hydraulic drive, an electromagnetic drive, a linear motor, a linear actuator, a cam, a solenoid, combinations thereof, and/or the like.

According to some of the various embodiments, the vaping liquid dispensing apparatus 200 may comprise additional processing modules such as, but not limited to: a capping module 262, a labeling module 264, a mixing module 266, a delivery module 268, combinations thereof, and/or the like.

The capping module 262 may be configured to seal at least one of the at least one user container 220. The sealing may involve attaching a lid to a user container 220, signaling a person to place a lid on user container 220, bending and gluing user container 220, a combination thereof, and/or the like. Positioning mechanism 230 may be configured to align at least one of the at least one container holder 225 with the capping station 262.

The labeling module 264 may be configured to apply at least one label to at least one of the at least one user container 220. The labeling may involve printing on the user container 220, placing a label on user container 220, wrapping user container with a material containing labeling information on user container 220, a combination thereof, and/or the like. Positioning mechanism 230 may be configured to align at least one of the at least one container holder 225 with the labeling station 264.

The mixing module 266 may be configured to mix the contents of at least one of the at least one user container 220. The mixing may employ a vortex mixer, a mechanical mixer, a magnetic mixer, a vibrator, a shaker, a combination thereof and/or the like. Positioning mechanism 230 may be configured to align at least one of the at least one container holder 225 with the mixing station 266.

The delivery module 268 may be configured to remove at least one of the at least one user container from the vaping liquid dispensing apparatus 200. The removal may be via a prompt to a user, via a mechanical manipulator, via a conveyer belt, a combination thereof, and/or the like. Positioning mechanism 230 may be configured to align at least one of the at least one container holder 225 with the delivery module 268.

According to some of the various embodiments, the vaping liquid dispensing apparatus 200 may comprise at least a controller module 240. Controller module 240 may comprise one or more processors and associated support devices. Controller module 240 may comprise a computing device that interfaces with peripheral device(s) such as sensors, actuators, other computing equipment, combinations thereof, and/or the like. According to some of the various embodiments, controller module 240 may be configured to measure a volume of the at least one of the multitude of vaping liquids employing at least one of the following fluid quantity sensors: an external sensor, an internal sensor, a scale, a flow sensor, a level sensor, a combination of the above, and/or the like. A sensor may comprise a transducer whose purpose is to sense (that is, to detect) some characteristic of its environs. The sensor may detects events or changes in quantities and provides a corresponding output, generally as an electrical or optical signal; for example, a flow sensor may convert a flow of liquid to an output voltage, a current, a digital value, a resistance, a combination thereof, and/or the like. Some sensors may comprise circuitry to allow the sensor to communicate to a computing device such as controller module 240 via a communications link.

According to some of the various embodiments, at least one flow measurement sensor 291 may be mounted proximate to nozzle 290. The flow measurement sensor 291 may be configured to measure the flow rate of vaping liquid being dispensed. Examples of flow measurement sensor 291. A flow sensor may comprise a device for sensing the rate of fluid flow. Typically a flow sensor may comprise a sensing element used in a flow meter, or flow logger, to record the flow of fluids. Some of the various flow sensors may comprise a vane that is pushed by fluid and drive a rotary potentiometer, encoder or similar device. Other flow sensors may comprise sensors which measure the transfer of heat caused by a moving medium. This principle may employ microsensors to measure flow. Other flow sensors may comprise velocimeters that measure velocity of fluids flowing through them. For example, laser-based interferometry may be employed for flow measurements. Other flow sensors may employ Doppler-based methods for flow measurement. Yet other flow sensors may employ Hall Effect sensors mounted on a flapper valve, or vane, to sense the position of the vane, as displaced by fluid flow. In the case of small liquid flow, a flow sensor may comprise an optical drop counter.

According to some of the various embodiments, at least one machine container fluid quantity sensor(s) 276 may be mounted proximate to machine container(s) 270. The machine container fluid quantity sensor(s) 276 may be configured to measure the level of vaping liquid in machine container(s) 276. Examples of fluid quantity sensor(s) comprise, but are limited to conductive sensors (e.g. sensors that have multiple electrical contacts that are shorted by fluid), optical sensors, acoustic sensors, weight sensors, combinations thereof, and/or the like. For example, a machine container weight sensor may be employed as a machine container fluid quantity sensor 276. The weight of the machine container may indicate the percentage of fluid in the machine container 270. Examples of weight sensors comprise, but are not limited to: load cells, piezo electric sensors, spring and weight sensors, scales, combinations thereof, and/or the like.

Similarly, and according to some of the various embodiments, at least one user container fluid quantity sensor (e.g. 226A and/or 226B) may be mounted proximate to at least one of the at least one user container and configured to measure the level of vaping liquid in at the least one of the at least one user container. As illustrated, the user container quantity sensor may be a scale 226 B, a level sensor 226A, combinations thereof, and/or the like. The fluid quantity sensors may be similar to fluid quantity sensors discussed above for measuring the quantity of vaping liquid in a machine container 270.

According to some of the various embodiments, identification sensors may be employed to identify various user container(s) 220. For example, a user container identification sensor 224 may be employed to read a machine readable user container identifier 222 that may be located proximate to a user container 220. The user container identification sensor 224 may be communicatively connected to controller module 240. The machine readable user container identifier 222 may be employed to identify the specific a user container 220. The machine readable user container identifier 222 may comprise one or more of the following: a bar code, an RFID (Radio Frequency Identifier), a near-field communication (NFC) device, combinations thereof and/or the like. The user container sensor 224 may be a device that is compatible with the machine readable user container identifier 222. So for example, if the machine readable user container identifier 222 is a bar code, the user container sensor 224 may comprise a bar code reader.

The controller module 240, may be, according to some of the various embodiments, configured to operate the measuring pump module 280 based, at least in part, on a measured volume of at least one of the multitude of vaping liquids. In such an embodiment, the controller may operate the pump to deliver one of the vaping liquids until a measurement senor indicates that the desired quantity of liquid has been delivered.

According to some of the various embodiments, controller module 240 may be configured to communicate with a computer or other computing device to: report on vaping liquid dispensing apparatus 200 status, receive operating instructions, interact with operators and/or consumers, interact with web sites, combinations thereof, and/or the like.

According to some of the various embodiments, the vaping liquid dispensing apparatus 200 may comprise an interface to accept instructions such as, for example, a point of sale module 210. The point of sale module 210 may be configured to, for example, accept order(s) from user(s), receive payment from the user(s) for the order(s), and generate production instructions configured to fill the order. According to some of the various embodiments, controller module 240 and point of sale module 210 may be integrated and/or share various components, such as, for example, processor(s), memory, communications interfaces, displays, input devices, sensors, actuators, combinations thereof, and/or the like. Similarly, controller module 240 and/point of sale module 210 may comprise a series of distributed components such as, for example, processor(s), memory, communications interfaces, displays, input devices, sensors, actuators, combinations thereof, and/or the like.

According to some of the various embodiments, the production instructions may comprise a set of instructions that may be employed by, for example, controller module 240 operate the various elements of the vaping liquid dispensing apparatus 200 to mix and dispense vaping liquids in user container(s) 220. The production instructions may comprise mixing instructions generating from a formula comprising at least one mixing ratio of at least two of the multitude of vaping liquids. The mixing instructions may comprise a list comprising a quantity value for each of at least one of the at least one identified vaping liquid. Examples of the multitude of vaping liquids comprise, but are not limited to, at least two of the following: propylene glycol, glycerin, water, nicotine, flavorings, combinations of the above, and/or the like.

Figure 3:
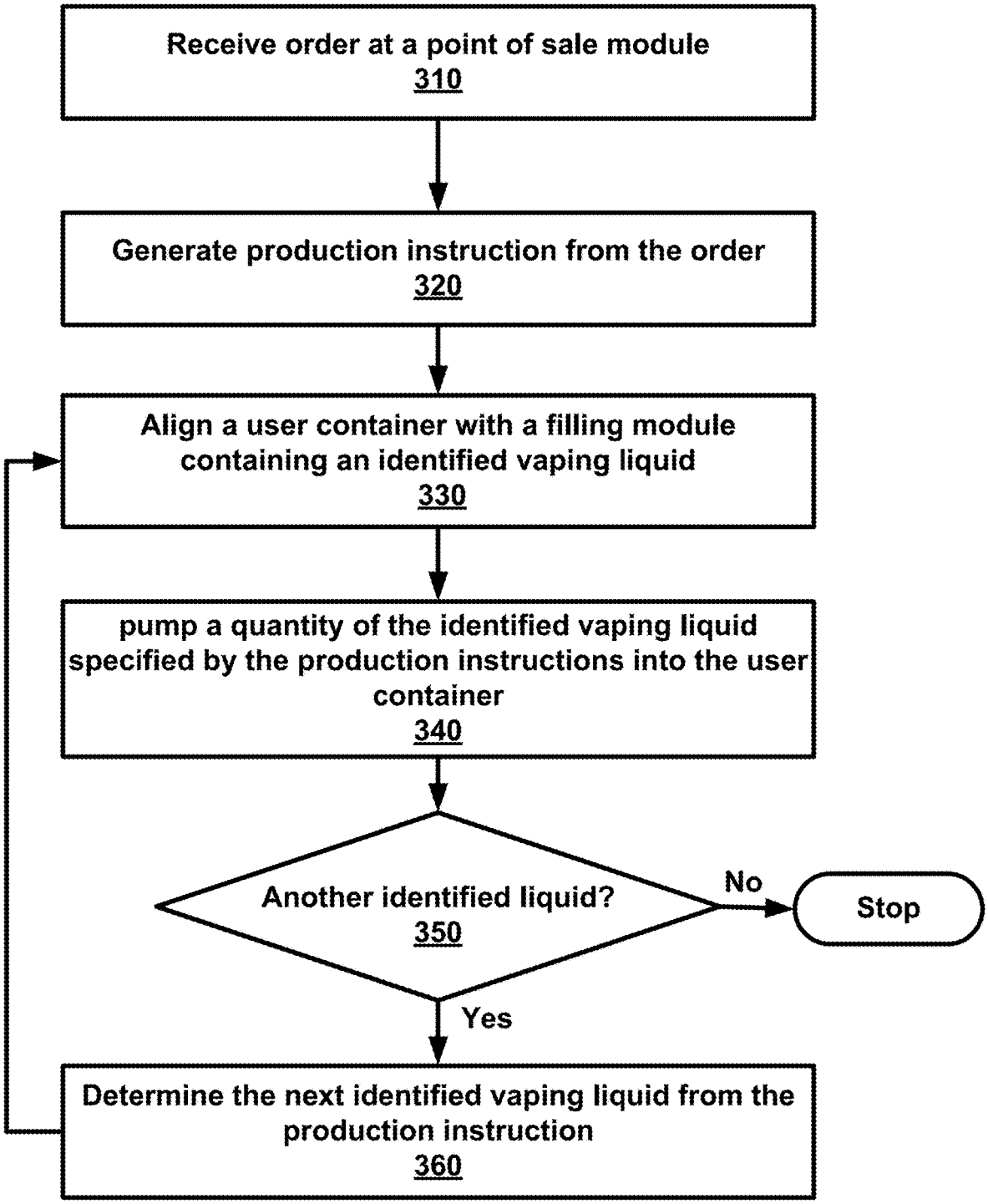
FIG. 3 is a flow diagram of vaping liquid dispensing operations according to aspects of some of the various embodiments.

FIG. 3 is a flow diagram of vaping liquid dispensing operations according to aspects of some of the various embodiments. The controller module 240 may be configured to execute production instructions. The production instructions may comprise mixing instructions for at least one of at least one identified vaping liquid from the multitude of vaping liquids.

As illustrated in FIG. 3, an order may be received at 310 from, for example, a point of sale module 210. According to alternative embodiments, the instructions may be received over a network, from an operator, from a computing device, from a mobile device, combinations thereof, and/or the like. Production instructions may be generated from the order at 320. The instructions may convert the final order into a series of vaping liquid dispensing apparatus 200 controlling commands. At 330, at least one of the at least one user container holder 225 may be aligned, employing the positioning mechanism 230, with at least one of the at least one filing module 250 containing the at least one identified vaping liquid. At 340, a measured volume of the at least one identified vaping liquid from the at least one filing module 250 containing the at least one identified vaping liquid may be dispensed employing measuring pump module 280 to a user container 220 according to mixing instructions. A determination may be made at 350 if another vaping liquid should be dispensed into user container 220. If the determination is positive, the next identified vaping liquid may be identified from the mixing instructions and the process returned to 330.

Figure 4:
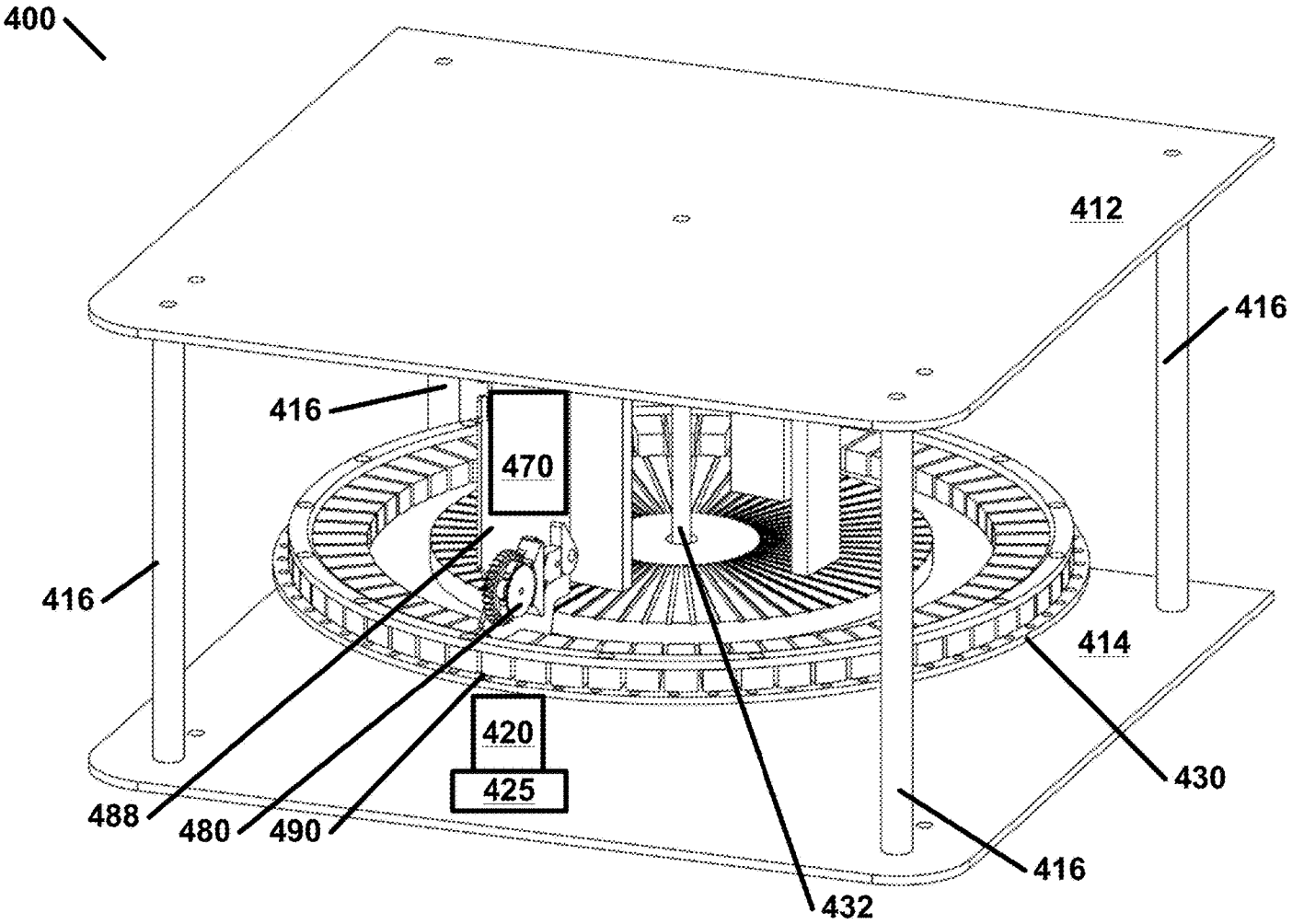
FIG. 4 is a diagram of a vaping liquid dispensing carousel according to aspects of some of the various embodiments.

Example FIG. 4 is a diagram of a vaping liquid dispensing carousel 400 according to aspects of some of the various embodiments. The vaping liquid dispensing carousel 400 may comprise a top plate 412 and bottom plate 414 separated by spacing structures (e.g. 416). A series of support structures (e.g. 488) may be placed on positioning support platter 430 that rotates around a central axis 432 on a rotating plate. Machine container(s) 470 may be supported on the support structure 488. Measuring pump modules(s) 480 may be mounted on the positioning support platter 430 and/or support structure 488. The measuring pump modules(s) 480 may dispense measured amounts of vaping liquids through a nozzle 490 into user container 420. User container 420 may be held in position by user container holder 425.

Figure 5:
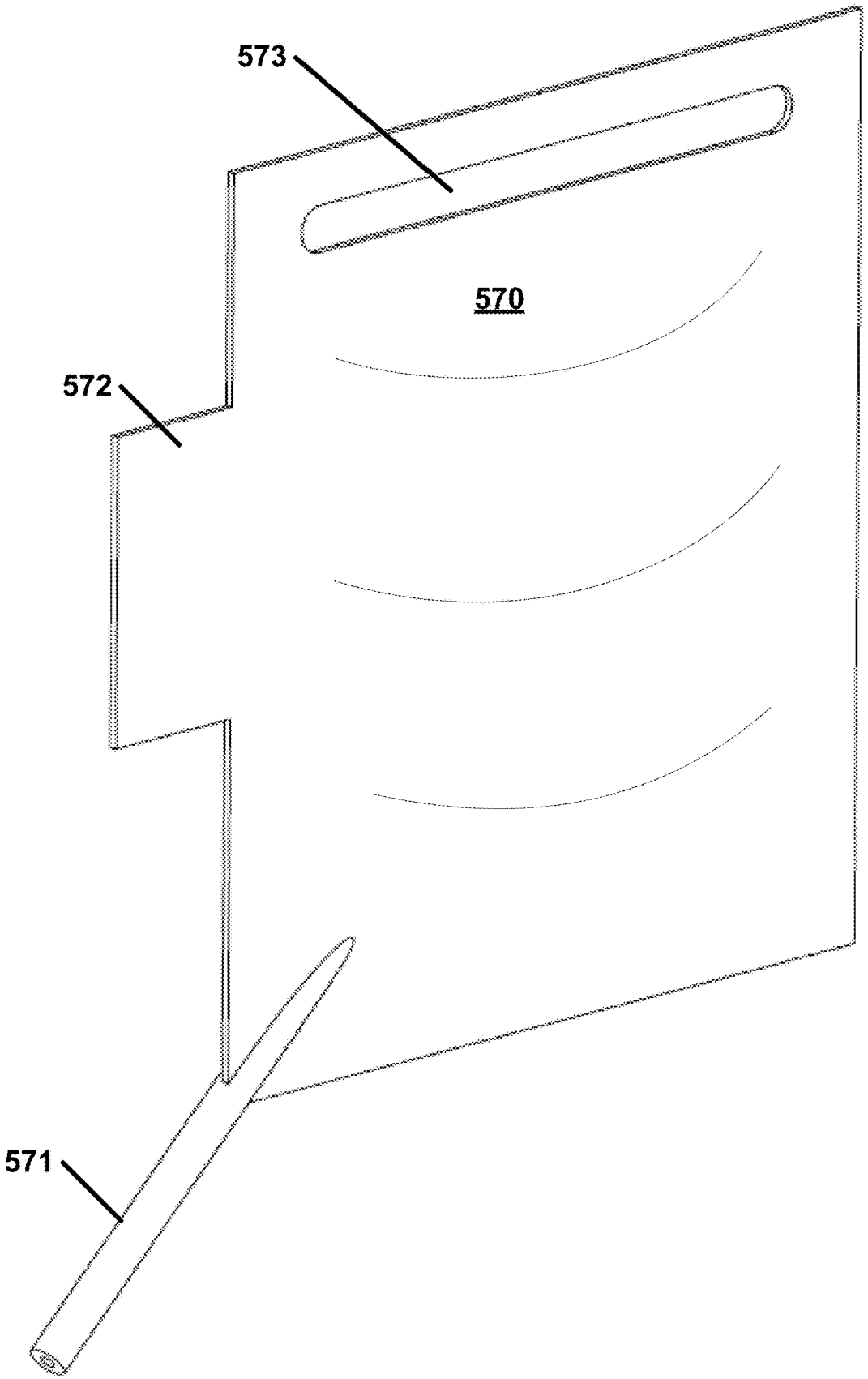
FIG. 5 is a diagram of a machine container according to aspects of some of the various embodiments.

Example FIG. 5 is a diagram of a machine container 570 according to aspects of some of the various embodiments. As illustrated machine container 570 may comprise a bag configured to hold a vaping liquid. In this example embodiment, the bag may expand to hold various quantities for vaping liquid. A notch 572 may be employed to align a machine container 570 to a machine container holding apparatus such as, for example, a support plate. A hanger slot 573 may be employed to hang machine container 570 from a support hook in a vaping liquid dispenser. A tube 571 may be employed to deliver the vaping liquid contents of the machine container 570 to a pumping module and/or nozzle.

Figure 6B:
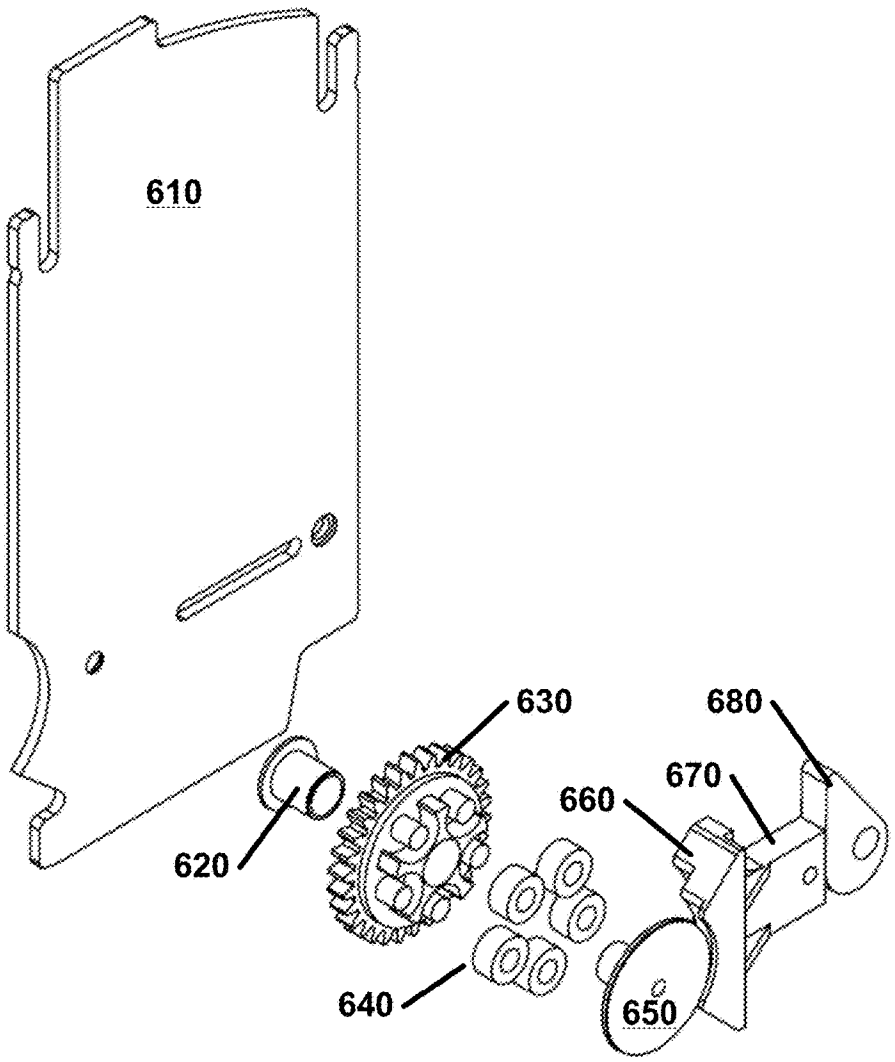
FIG. 6B is an exploded view diagram of the peristaltic measuring pump module illustrated in FIG. 6A according to aspects of some of the various embodiments.
Figure 6A:
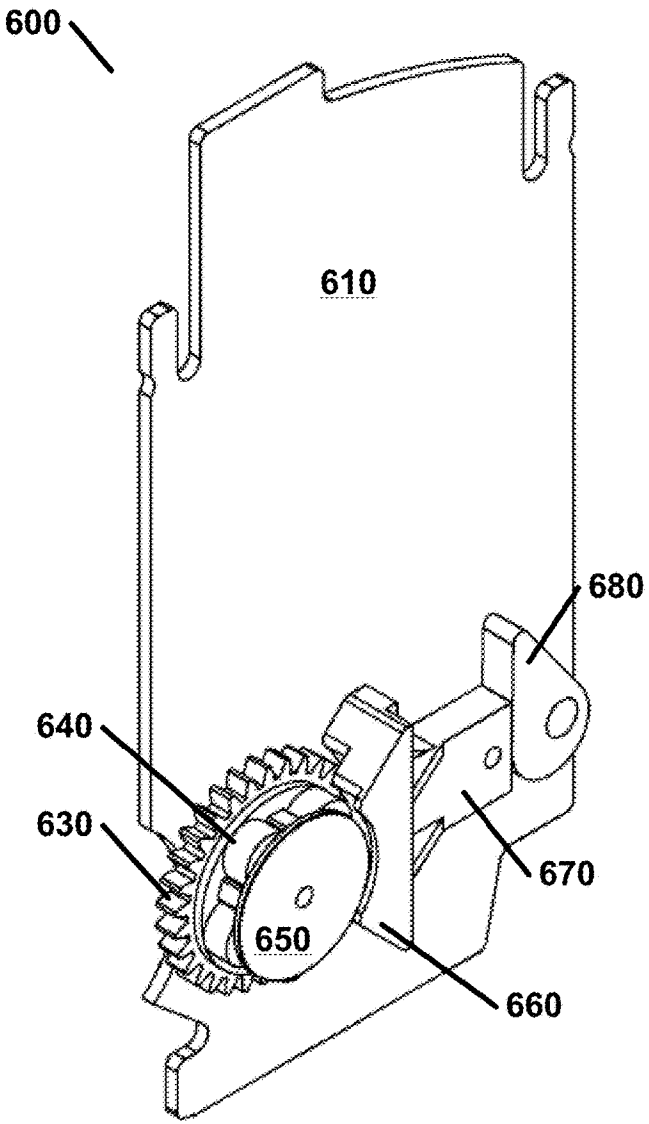
FIG. 6A is a diagram of a peristaltic measuring pump module according to aspects of some of the various embodiments.

Example FIG. 6A is a diagram of a peristaltic measuring pump module 600 according to aspects of some of the various embodiments. Example FIG. 6B is an exploded view diagram of the peristaltic measuring pump module 600 illustrated in FIG. 6A according to aspects of some of the various embodiments. Peristaltic pump 600 is a type of positive displacement pump that may be employed to pump measured amounts of vaping liquids. The fluid may be contained within a flexible tube (not shown) that may be threaded through the peristaltic measuring pump module 600. The pumping mechanism is relatively circular. A series of rollers 640 may be disposed on a geared rotor 630 and mounted on a support structure 610 between a bushing 620 and a bushing cap 650. The flexible tubing may be thread between the rollers and a tubing guide 660. The tubing guide 660 may be pressed against the tubing by a cam 680. Measured amounts of vaping liquid may then be pumped from a machine container by rotating the rotor 630 by engaging a controllable motor such as, for example, a stepper motor to the gears on the circumference of the rotor 630. As the rotor 630 moves, the part of the tube under compression may be pinched closed by the rollers 640 forcing the vaping liquid through the tube.

According to some of the various embodiments, a measuring pump module may comprise a measuring pump that comprises at least two pinch valves and at least one tubing depressor. Example FIG. 7A is a diagram of a finger pump integrated into a pumping module as per aspects of an embodiment of the present invention. Example FIG. 7B is an exploded view diagram of the finger pump shown in FIG. 7A as per aspects of an embodiment of the present invention.

Piston pumps and peristaltic pumps each may comprise certain advantages and disadvantages. A piston pump is simple with a piston moving in a cylinder and two one way valves. However, a piston pump may be difficult to clean without disassembly. Peristaltic pumps may be obtained in at least two variations, rotary and linear. Both rotary and linear peristaltic pumps may deliver fluid with low pulsation by moving a pressure/pinch point along flexible tubing. Rotary peristaltic pumps may comprise a rotor equipped with a number of rollers, a cylindrical race and a bearing supporting the main rotor. The race may be either retractable adding to complexity or require disassembly for change of the tubing. Linear peristaltic pumps may employ a plurality of tubing depressors pressing on the flexible tubing in a synchronizer sequence. Some of the various linear pumps may comprise eight to ten tubing depressors and a multi surface cam suspended on two bearings. The tubing depressors may squeeze the tubing against a surface that may be retractable for loading and unloading of the tubing. Both types of peristaltic pumps offer cleanliness advantages since the surfaces in contact with the pumped fluid are disposable (disposable tubing). They also may be more mechanically complex then piston pumps.

Figure 7B:
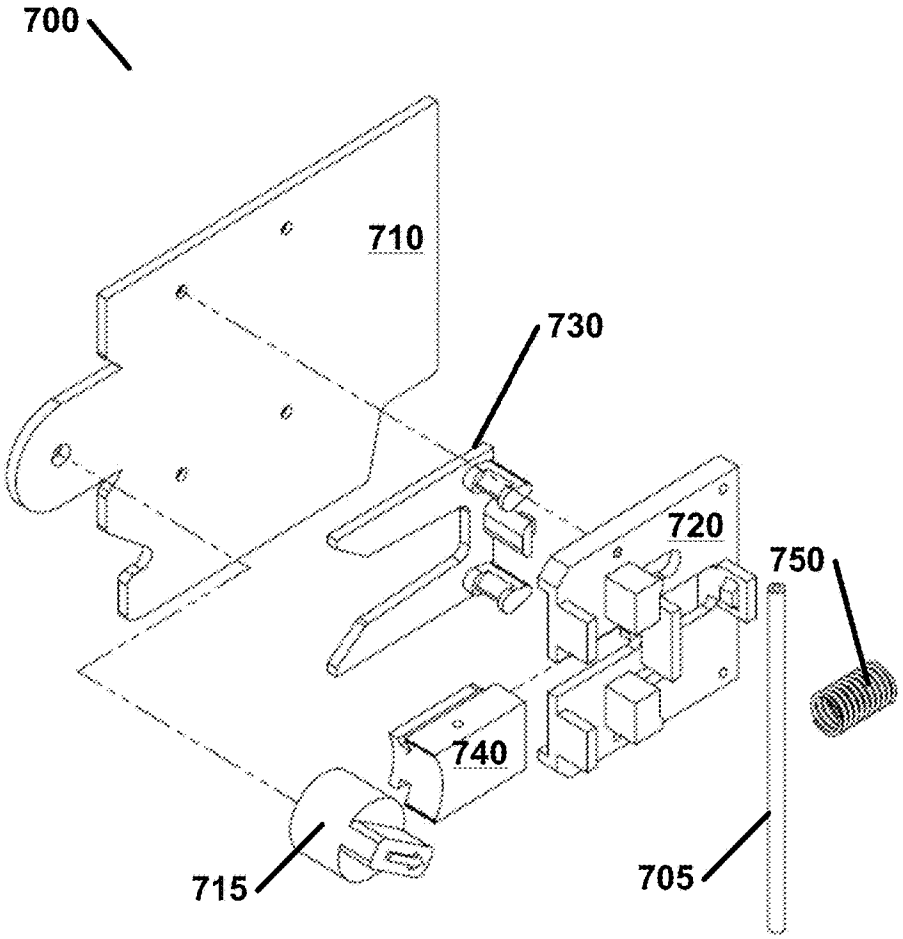
FIG. 7B is an exploded view diagram of the finger pump shown in FIG. 7A as per aspects of an embodiment of the present invention.
Figure 7A:
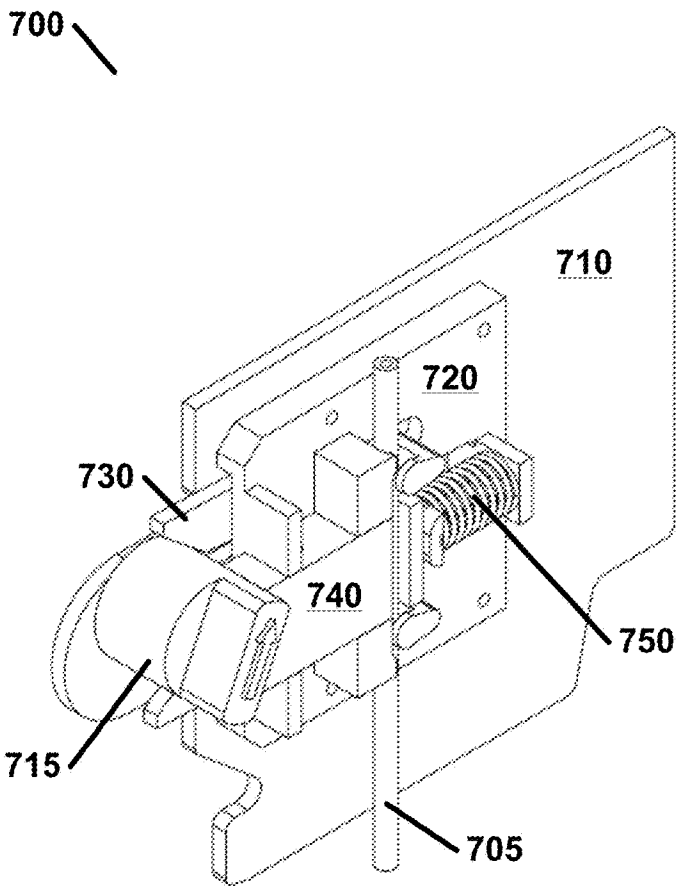
FIG. 7A is a diagram of a finger pump integrated into a pumping module as per aspects of an embodiment of the present invention.

The finger pump illustrated in FIGS. 7A and 7B may offer the advantages of both piston pump and the peristaltic pump with, as shown in this example embodiment, only two moving parts (e.g. 730 and/or 740) and a spring 750 mounted in a frame 710. A finger/depressor 740 and a double pinch valve 730 may both be actuated by a single surface cam 715 to move vaping liquid through a tube 705. The cam may comprise an eccentric cylindrical surface. Further, the eccentric cam 715 may comprise a ball bearing, a roller bearing, and/or the like mounted on a rotating crank shaft. Since the cam 715 may be external to the pumping mechanism, the cam 715 may be employed with multiple pumps allowing sequential dispensing of different fluids in a single system. A bank of pump modules may move with respect to the eccentric mechanism or a bank of pumps may be stationary and the cam surface may move between pumping modules. In another embodiment a single cam 715 may be configured to be wide enough to engage multiple modules resulting in synchronized dispensing of multiple fluids. Combinations of the above described embodiments, and/or the like may be implemented to create hybrid pumping systems.

FIGS. 8A through 8F illustrate a sequence of six pumping stages within a single pumping cycle. Specifically, FIG. 8A illustrates a standby position stage, FIG. 8B illustrates an open bottom valve stage, FIG. 8C illustrates a start ejection stage, FIG. 8D illustrates an ejected and valves closed stage, FIG. 8E illustrates a suction stage, and FIG. 8F illustrates a top valve closing stage. In the standby position stage (FIG. 8A), the eccentric is not in contact with the pump components. Due to the force applied by the spring both pinch valves may be closed and the tubing depressor/finger retracted. In the open bottom valve stage (FIG. 8B), the eccentric may be engaged with the bottom race of the pinch valve pressing it down and opening the bottom valve. In the start ejection stage (FIG. 8C), the eccentric may be engaged with the bottom race of the pinch valve and with the finger/actuator pressing on the tubing and ejecting fluid through the open bottom valve. In the ejected and valves closed stage (FIG. 8D), the eccentric may be pressing on the finger/actuator with both valves closed. The fluid may be ejected from the active section of the tubing. In the suction stage (FIG. 8E), the eccentric may be engaged with the finger/actuator and starts depressing the top race of the pinch valve opening the top valve. At the same time it is rolling of the finger/actuator releasing the pressure on the tube resulting in suction of the fluid through the open top valve. In the top valve closing stage (FIG. 8F), the eccentric may be rolling of the top race of the pinch valve. Under the force of the spring the top valve is closing.

The end result moves a fixed volume of fluid per cycle. The pumping may be characterized by pulsation that may be useful in dispensing applications. The amount dispensed per cycle may be set by tubing size, the length of the tubing section engaged by the finger/actuator and by the displacement of the finger/actuator. At the price of adding more components to the pump, the surface supporting the tubing under the finger/actuator may be movable allowing adjustment of the volume per cycle. A screw mechanism, a wedge mechanism, a cam mechanism and/or other mechanism may be employed to adjust the position of the supporting surface. Since the tubing may be in constant contact with the surfaces of the pump, the tubing may not require restricting clamps necessary in rotary peristaltic pumps to prevent the tubing from walking due to moving rollers. Replacement of the tubing may not require a movable race surface since the pinch valves may be retracted by pushing on the actuator surfaces of the pinch valve and the finger/tubing depressor may not press on the tube in the standby position or when the module is removed for service.

Embodiments of the present invention may be employed as a point of sale vending mechanism for mixing, blending and fusing various liquid compounds on demand. A software interface may enable a customer to adjust, modify and customize amounts of flavor extract, menthol, nicotine levels and other ingredients in order to create a customized compound of liquid that may be employed, for example, in electronic cigarettes, personal vaporizers, and/or the like. The customized compound may be mixed by a mechanism configured to dispense into, for example, a disposable one time cartridge, use containers, large volume containers (for e.g. allowing a user to refill their own e-cigarette), and/or the like.

According to some of the various embodiments, the mechanism may verify that a customer is of legal age by, for example, by scanning the individual's driver's license or state issued ID card prior to mixing any ingredients. The mechanism may allow the customer to either pay with cash, credit or debit. The mechanism may also verify that the customer has paid for the liquid prior to mixing any ingredients by, for example, through bill and change scanning technology, internet protocol software, and/or the like.

According to some of the various embodiments, the mechanism may cap, seal and/or package a pre-determined container of liquid and dispense it to the customer. Embodiments may also employ mechanism(s), such as but not limited to shaking the fluid composition, to uniformly distribute the fluid composition. The mechanism may heat the dispensed container of fluid employing, for example, convection heating, conduction heat transfer, and/or the like.

Embodiments may accept empty containers for recycling and/or provide customers with a discount or credit. Communications capable software may continuously monitor fluid levels and inventory in a machine according to some of the various embodiments to ensure that the machine is replenished before it is unable to provide a consistent product. Communications may employ wired or wireless communications interfaces. Communications data may be transferred over the communications interface employing a protocol such as an Internet protocol. Software may monitor the function of the mechanism. The monitoring may alert service centers for preventative maintenance and/or repairs. The alerts and monitoring may be performed in real time.

Various embodiments of the mechanism are described more fully hereafter with reference to the accompanying drawings and flow diagrams, but not all embodiments of the invention are shown in the figures. The components may be embodied in many forms and should not be construed or interpreted as limited to the embodiments set forth herein; rather, these embodiments are provided so that this disclosure will satisfy all legal requirements.

Figure 9:
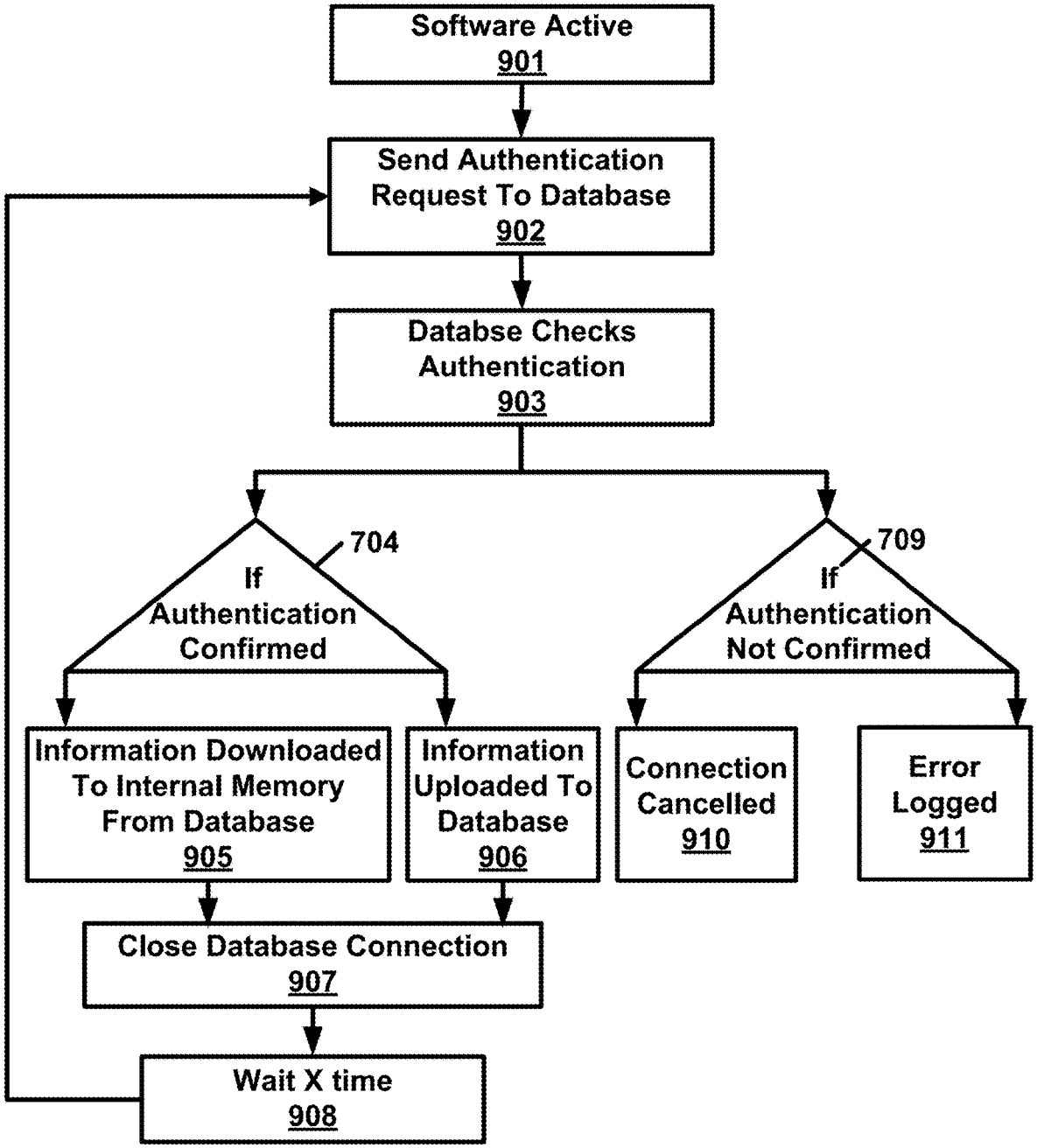
FIG. 9 is a flow diagram illustrating aspects of various embodiments of the present invention.

FIG. 9 illustrates an example flow diagram of a process through which software connects via a communications protocol (e.g. Internet protocol) to download information to internal memory and upload information to a database. At block 901, power may be applied to a microcontroller and software activated. At block 902, an authorization request may be sent to a server. At block 903, access permission may be authenticated by the server. If the authentication request is confirmed at 904, information may be downloaded from the server to the unit at 905 and information may be uploaded from the unit to the server at 906. The server connection may be terminated at 907. At 908, the software may wait a given amount of time before repeating a request to connect to the server. At 909, a determination may be made if the authentication request is denied by the server. At 910 the connection to the server may be cancelled and at 911 the identification code assigned to the unit may be logged in a database and notification of the error sent to an appropriate party.

Figure 10:
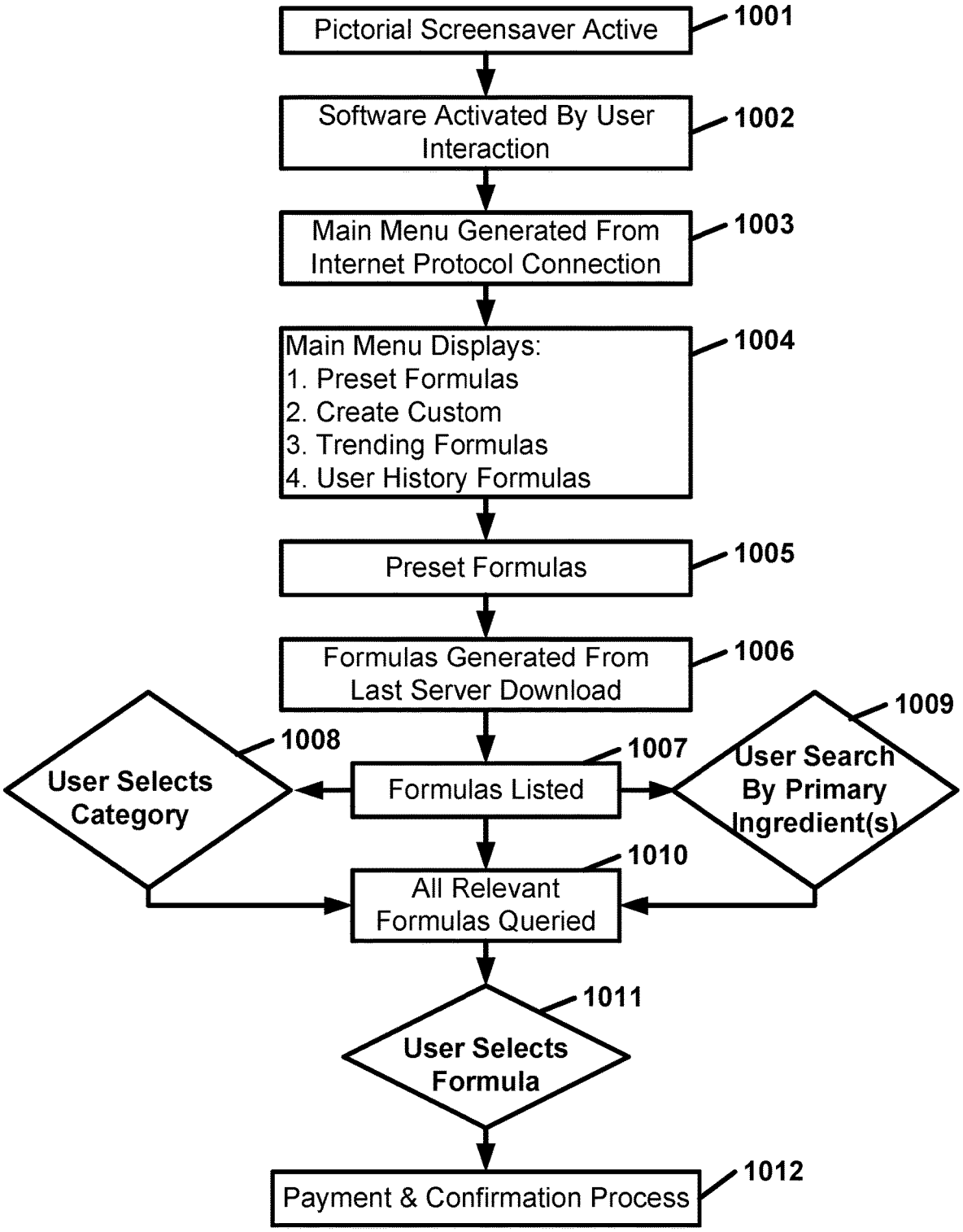
FIG. 10 is a flow diagram illustrating aspects of various embodiments of the present invention.

FIG. 10 illustrates an example flow diagram of a method of formula selection in which a user may select a formula that has been downloaded from a database and stored within the internal memory of the mechanism. At 1001, images, video and/or other graphic(s) may be displayed in a loop until a user makes contact with the graphical user interface at 1002. At 1003, the main menu interface may be generated based upon data last downloaded from a server (see FIG. 17). At 1004, the menu may contain a minimum of 4 options. Other embodiments may include less than four options. At 1005, a user may select preset formulas. At 1006, formulas may be retrieved from internal memory. Some or all of the formulas may have been downloaded. At 1007, available liquid formulas may be listed. At 1008, a user may sort formulas based upon categories (at 1008) and/or by base ingredients (at 1009). At 1010, relevant formulas may be queried and displayed to a user. At 1011, a user may choose to modify a preset formula based upon their preferences (See FIG. 12 (1205)). At 1012, a user may select an individual formula. At 1013, a payment and/or confirmation process may be initiated.

Figure 11:
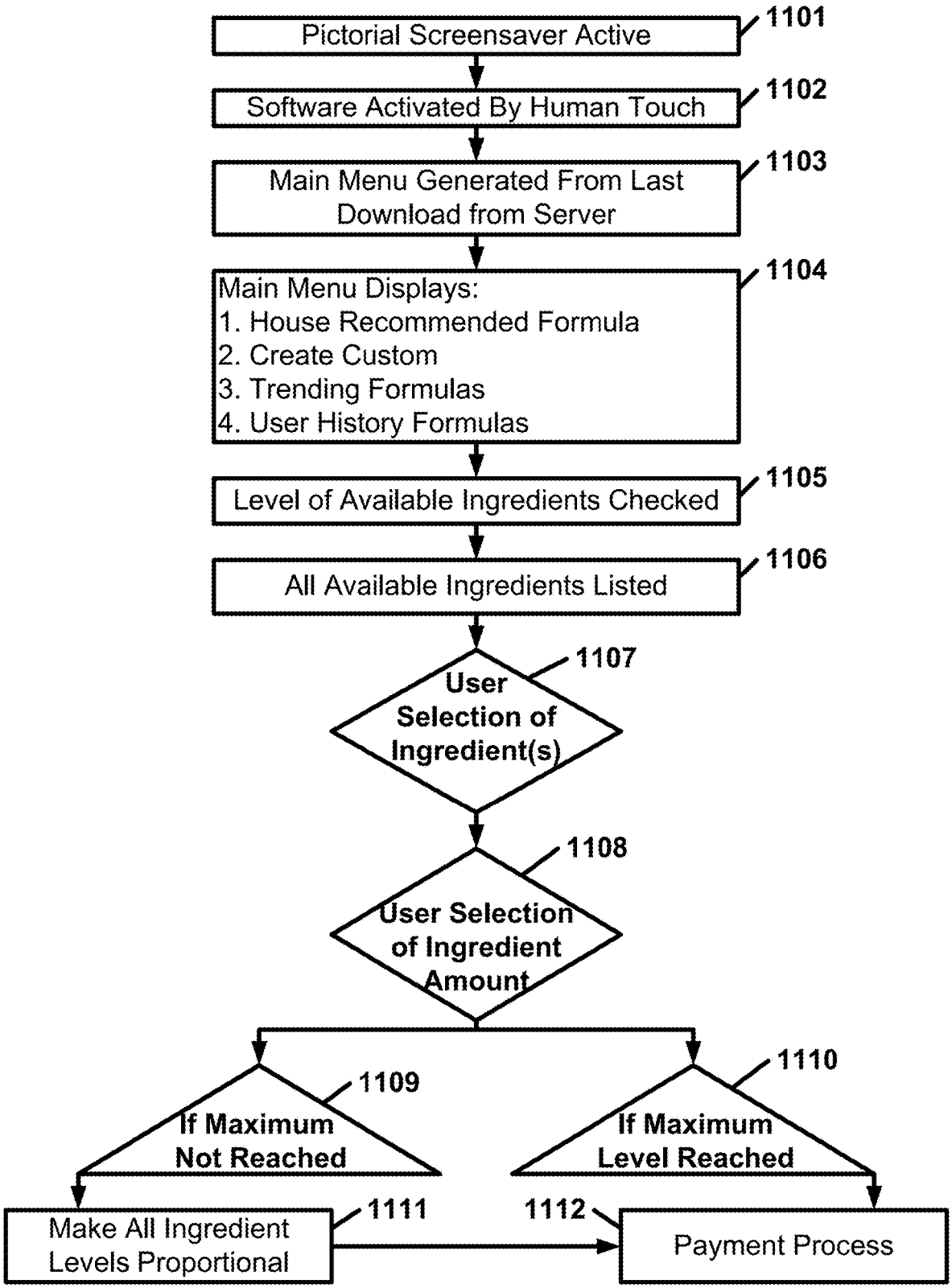
FIG. 11 is a flow diagram illustrating aspects of various embodiments of the present invention.

FIG. 11 illustrates an example flow diagram of a method of formula selection in which a user may create and customize a formula to their individual preferences. At 1101, a pictorial screen saver may rotate images, video and/or other graphic until a user makes contact with the graphical user interface at 1102. At 1103, a main menu interface may be generated based upon data. The data may have been downloaded from a server (see FIG. 17). The data may be the last data downloaded from a server. At 1104, a menu may contain options. At 1105, available liquid levels may be listed on the graphical user interface. At 1107, a user may select and adjust the quantity of individual liquid level(s). At 1108, a user may confirm that they would like to create the formula. At 1109, a calculation may be made if the maximum fill level has been reached. If the level is reached, a process to obtain agreement to the terms of conditions and/or a payment process may be initiated (See FIG. 14). At 1110, if it is determined that the maximum fill level has not been reached, the remaining space may be displaced with a filler. The remaining space may be calculated at 1111. The payment and confirmation process may be initiated at 1112 (See FIG. 14).

Figure 12:
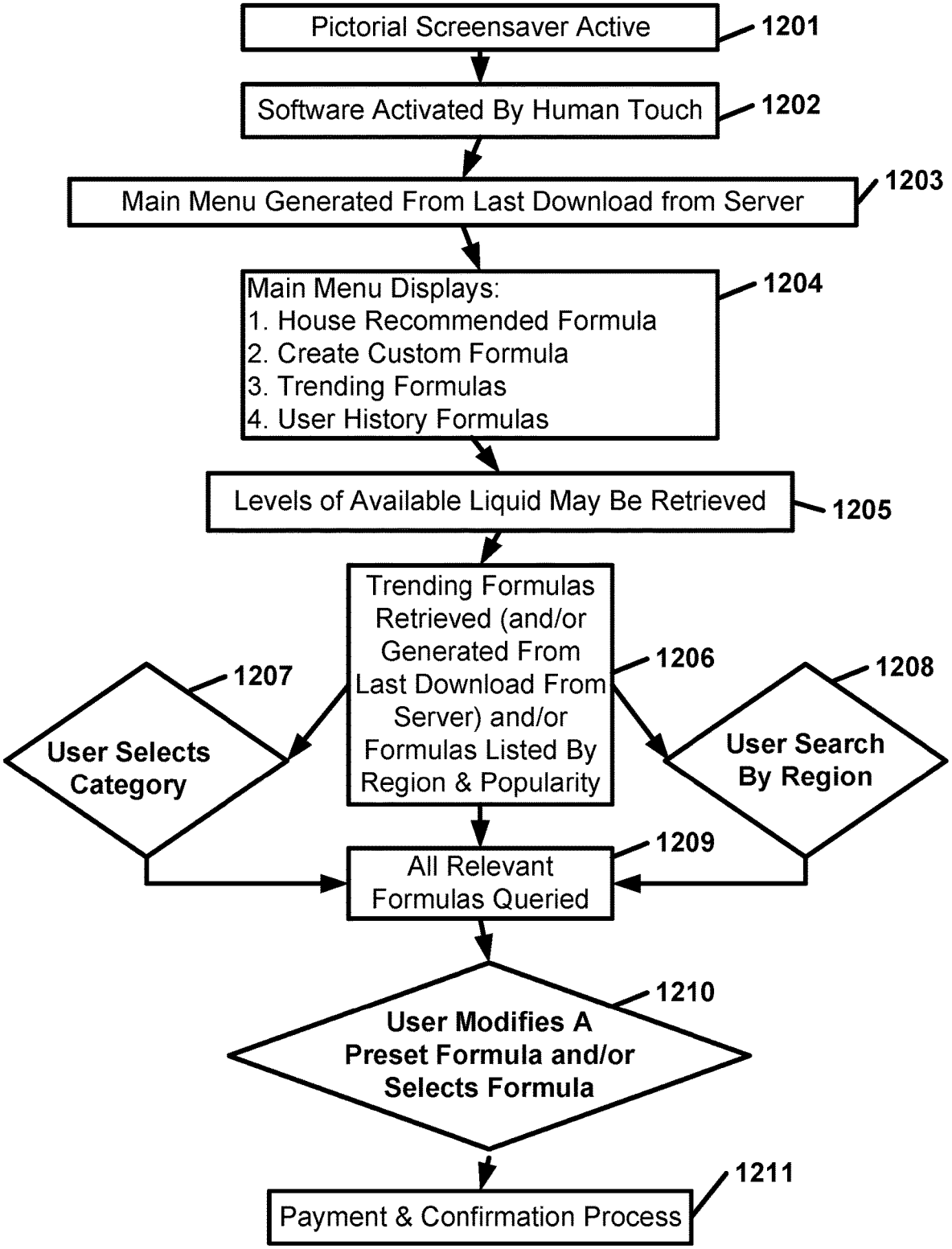
FIG. 12 is a flow diagram illustrating aspects of various embodiments of the present invention.

FIG. 12 illustrates an example flow diagram of a method of formula selection in which a user may select a formula that has been downloaded to internal memory and sorted based upon data quantified by a fixed measurable criteria. At 1201, images, video and/or other graphics may be rotated and/or displayed until a user makes contact with the graphical user interface at 1202. At 1203, a main menu interface may be generated based upon data. The data may be downloaded from a server. The data may be the last data downloaded from a server (see FIG. 17). At 1204, the menu may comprise, for example, at least 4 options. At 1205, levels of available liquid may be retrieved. The available liquid may be retrieved from a last checked fluid level. At 1206, formulas, which may include trending formulas, may be retrieved over a communications interface (e.g. from an (or the last) internet protocol connection). The formulas may have been downloaded to internal memory upon a previous communications connection. (e.g. an Internet protocol connection). Formulas may be listed. At 1207, a user may sort the formulas based upon categories (and/or search by region at 1208) and/or by base ingredients (as shown at 1313 in FIG. 13). At 1209, relevant formulas may be queried and/or displayed to a user. At 1210, a user may choose to modify a preset formula based upon their preferences and/or may select an individual formula. At 1211, a payment and/or confirmation process may be initiated.

Figure 13:
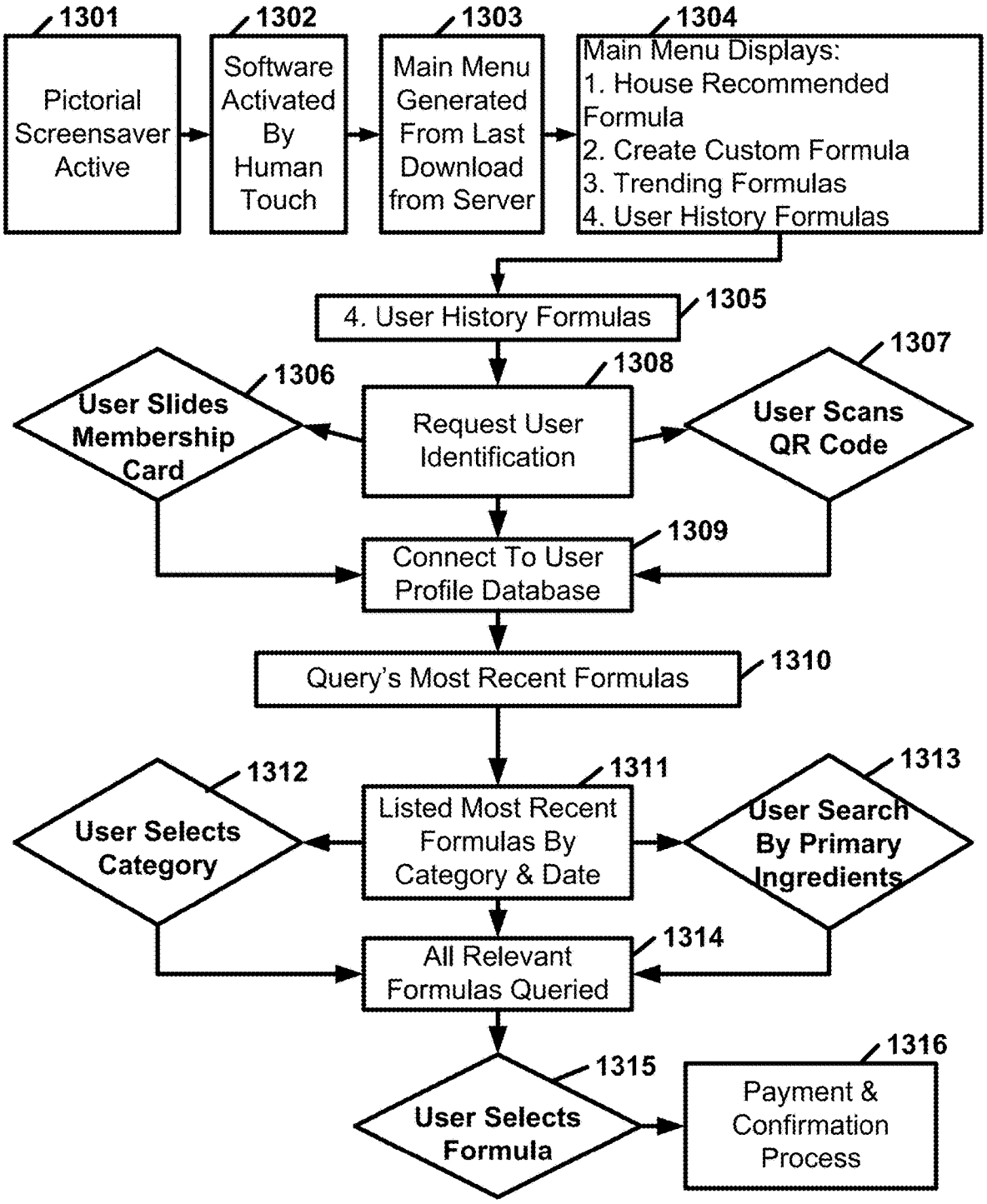
FIG. 13 is a flow diagram illustrating aspects of various embodiments of the present invention.

FIG. 13 illustrates an example flow diagram of the method of formula selection in which a user may select a previously purchased formula. At 1301, a pictorial screen saver may display images, video and/or other graphic until a user makes contact with the graphical user interface at 1302. At 1303, a main menu interface may be generated based upon data. The data may have been last downloaded from a server (see FIG. 17). A menu contains a minimum of 4 options at 1304. At 1305, levels of available liquid may be retrieved from the last checked fluid level. At 1305, a user history may be selected. At 1306 and/or 1307, the system may wait for user input. At 1309, upon a user inputting identification via numerical input, magnetic strip card, QR code, username password, a combination of the above, and/or the like, a connection to a user profile may be made. At 1310, formulas previously selected by the user may be downloaded from a server to the unit. At 1311, formulas may be listed. The user may sort formulas based upon categories (at 1312) and/or by base ingredients (at 1313). At 514, relevant formulas may be queried and displayed to the user. At 1315, the user may select individual formula(s). At 1316, a payment and/or confirmation process may be initiated (See FIG. 14).

Figure 14:
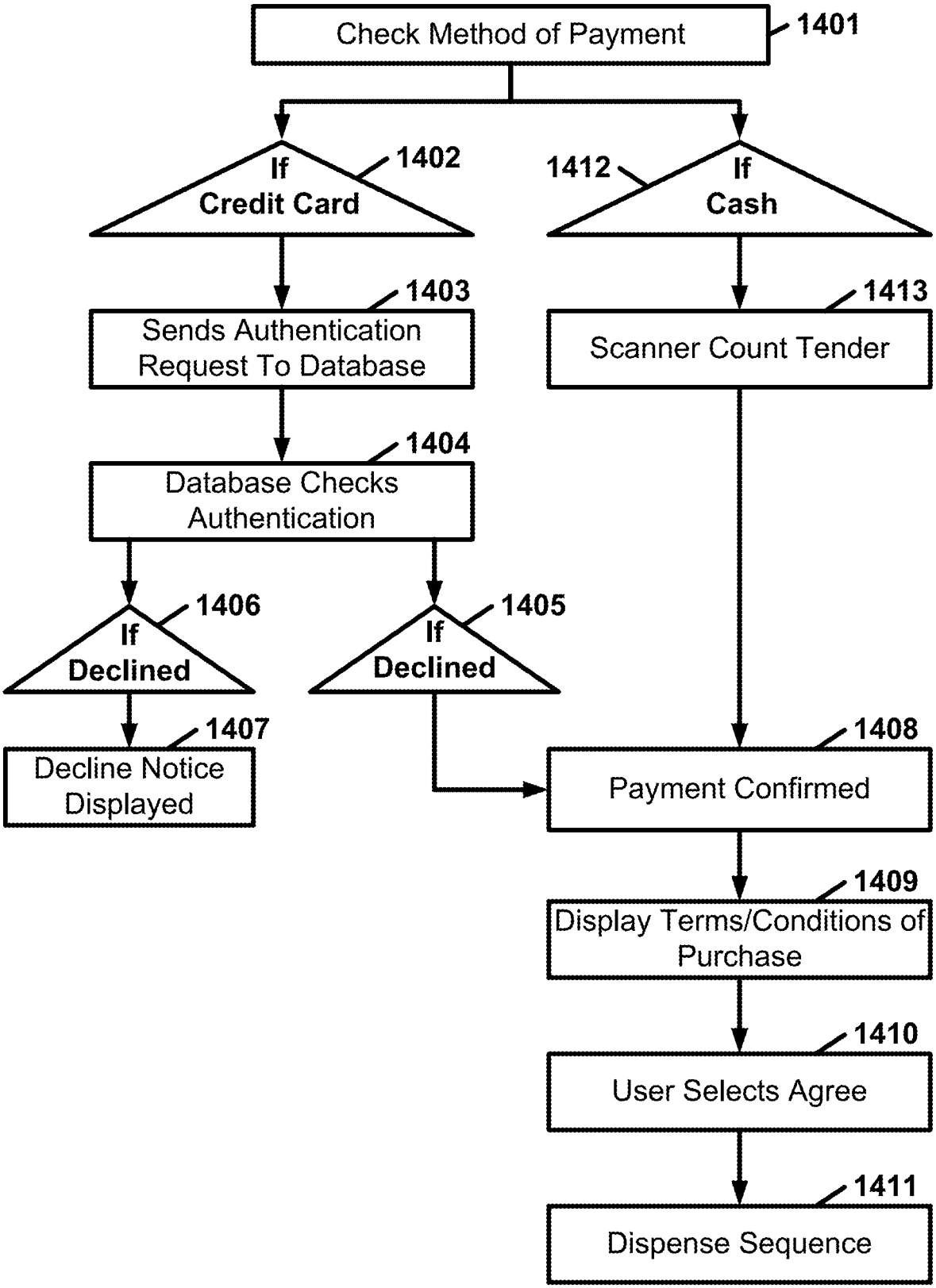
FIG. 14 is a flow diagram illustrating aspects of various embodiments of the present invention.

FIG. 14 illustrates an example flow diagram of a process through which it may be assured that a user has paid for their selection and agreed to the terms and conditions of a purchase. At 1401, a method of payment may be checked. At 1402, if a user has chosen to pay with credit card, an authorization request to a server may be sent at 1403 and/or access permission may be authenticated at 1404 by a server. At 1405, if the authentication request is confirmed, the payment may be processed and payment is confirmed within the unit at 1408 and terms and conditions may be displayed at 1409 when a user indicates agreement at 1410, the dispensing sequence may be initiated at 1411 (See FIG. 15). If an authorization request fails at 1406, a user may receive a decline notice at 1407. If the user has paid with cash at 1412, a scanner may be employed to ensure that the proper amount of tender is quantified at 1413. Once payment is confirmed at 1408, terms and conditions may be displayed at 1409. If a user indicates agreement at 1410, a dispensing sequence may be initiated at 1411 (See FIG. 15).

Figure 15:
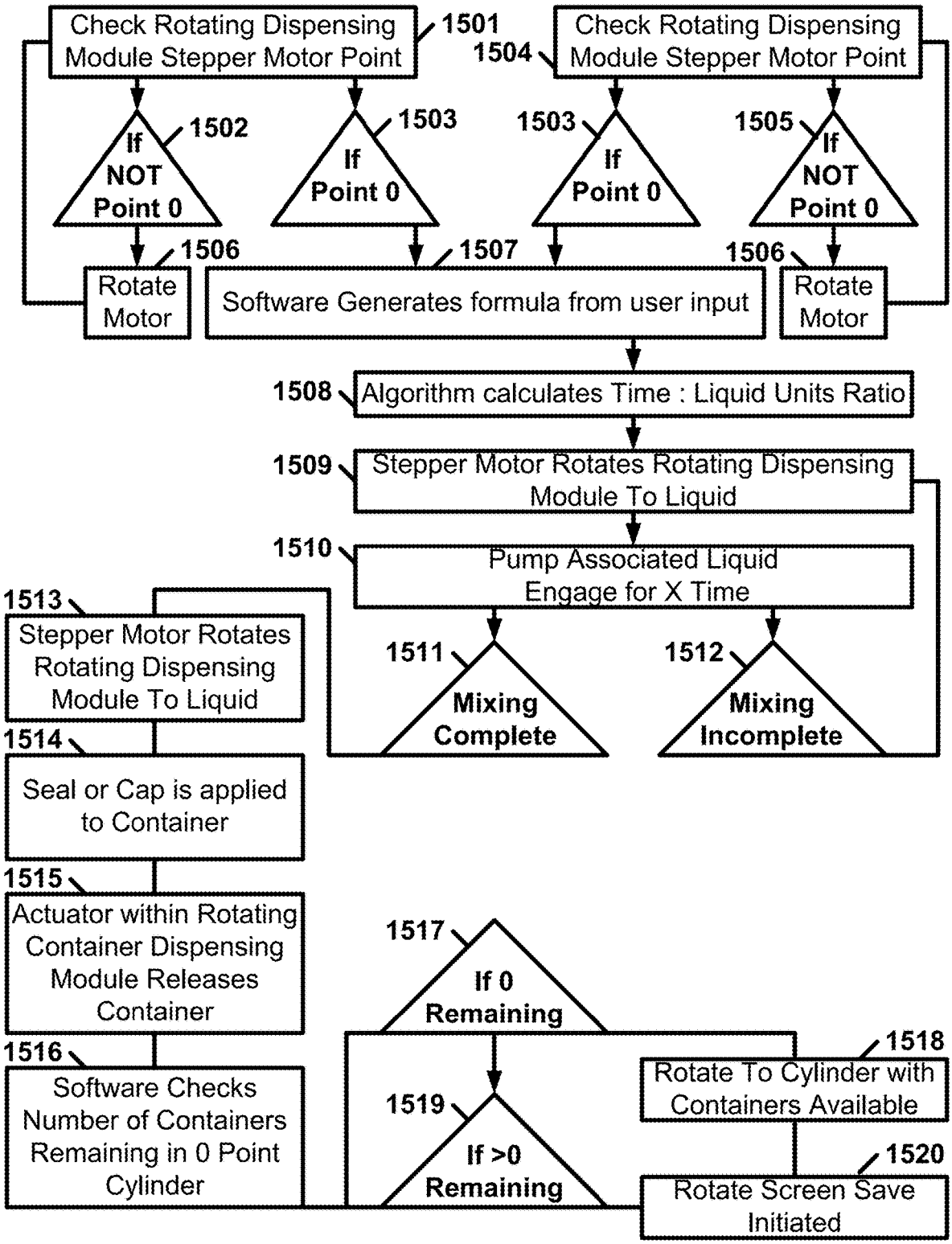
FIG. 15 is a flow diagram illustrating aspects of various embodiments of the present invention.

FIG. 15 illustrates an example flow diagram of a process through which liquid is mixed and containers are dispensed to the user. According to this example embodiments, a stepper motor may be set to a zero point for a rotating liquid dispensing module at 1501. If it is determined that a motor is not at zero point at 1502, the motor may be initiated until a zero point is reached at 1503. At 1504, a check may be made to insure that the stepper motor is set to a zero point for the rotating container dispensing module. At 1505, if the motor is not at a zero point, the motor may be initiated at 1506 until zero point is reached. If it is determined at 1503 that the motor turning the rotating liquid dispensing module and container dispensing module are at the zero point, the formula created by the user may be generated based upon the point at which each ingredient is located on the rotating liquid reservoir at 1507. A calculation of the ratio of pumping time to the unit of measurement may be performed at 1508. At 1509, the stepper motor may rotate the rotating liquid reservoir to a point listed in the user created formula. At 1510, the pump may be initiated for a duration set to satisfy the formula for the liquid referenced in the formula. The process may continue until the formula has been dispensed at 1511. If the mixing is determined to be incomplete at 1512, the process may return to 1509 where the stepper motor rotates rotating dispensing module to another liquid in the formula. Once it is determined that the mixing is complete at 1511, the stepper motor may rotate the rotating liquid dispensing module to the position required to seal the container at 1513. At 1514, a seal and/or lid may be attached to the container. A rotating container dispensing module actuator may force the container upward and through a channel into a slot for the customer to retrieve at 1515. At 1516, the number of containers remaining in the cylinder at the zero point on the rotating container dispenser may be checked. If zero containers are determined to be available at 1517, the stepper motor may rotate the rotating container dispenser to a cylinder with additional containers at 1518. At 1520, the Rotating Screen may be Initiated (See FIGS. 10, 11, 12, 13 (1)). If greater than 0 containers are determined to be in a cylinder at 1519, the Rotating Screen may be Initiated at 1520 (See FIG. 10, 11, 12, 13 (1)).

Figure 16:
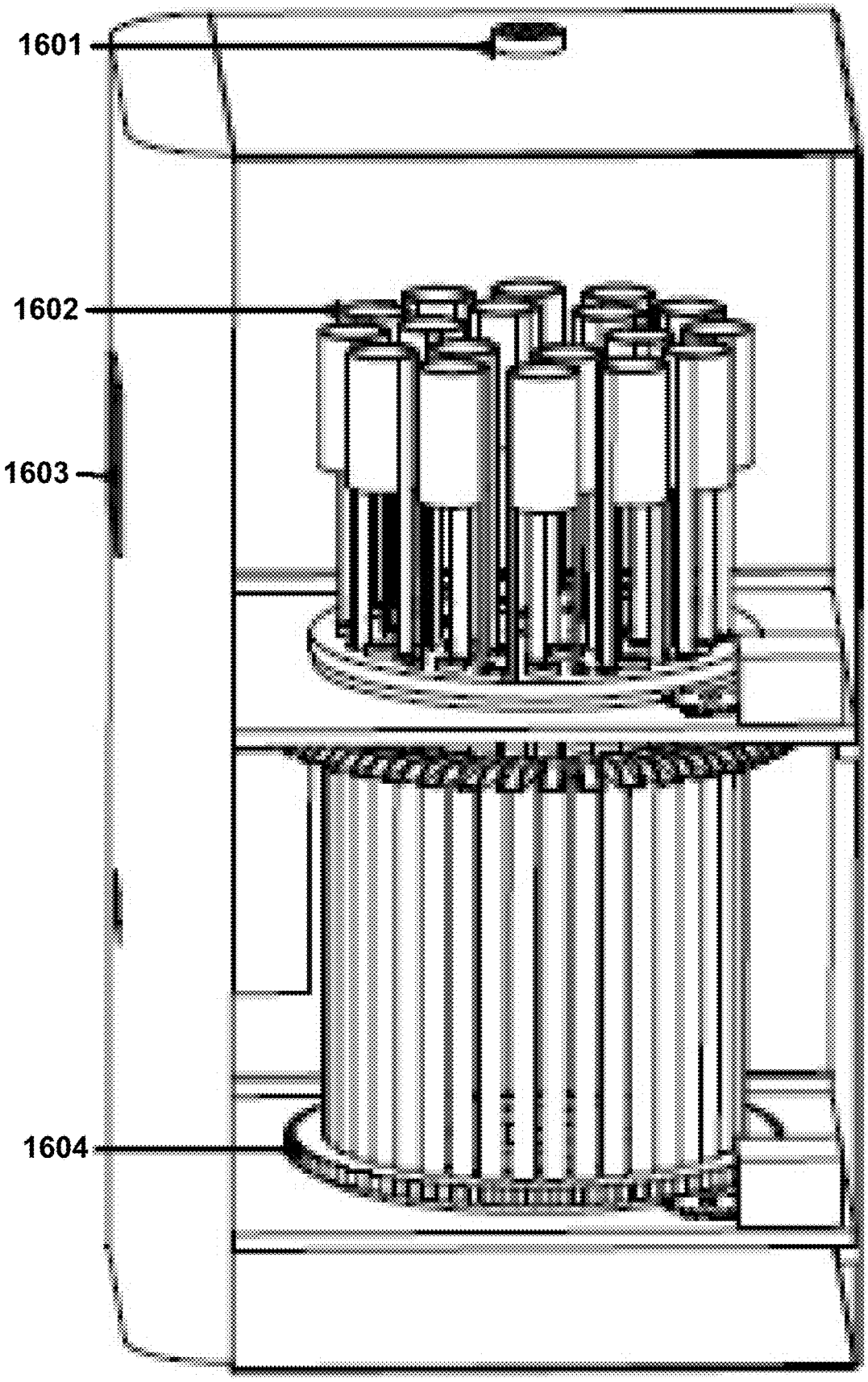
FIG. 16 is an illustration of aspects of various embodiment of the present invention.

FIG. 16 illustrates a view of example internal embodiments in an assembled fashion. Electronics to control the mechanism to function (microprocessor(s), relay and pump control circuits) may be housed in container 1601. According to this illustrative example embodiment, the mechanism would have this container mounted at the top of the machine. This may be accessed by a hinged door located on the inside of the machine. This example embodiment shows a fan mounted on the outside of the embodiment. A rotating liquid dispersing apparatus 1602 may be connected to a motor that allows the platform to be spun around a center axis. Pumps and nozzles may be mounted on the underside of the platform in this example embodiment. A panel may mount a touchscreen 1603, along with the credit card reader, Id scanner, QR code, barcode scanner, combination thereof, and/or the like. (4) The rotating container dispensing apparatus may comprise a circular platform controlled by a motor to provide rotation around its center axis. The embodiment shows vertical stacks in which the containers may be housed. Linear actuators may be disposed at the bottom of the vertical stack. The linear actuators may be configured to push the containers vertical so the fill nozzles may fill the container and dispense the container to the user.

Figure 17:
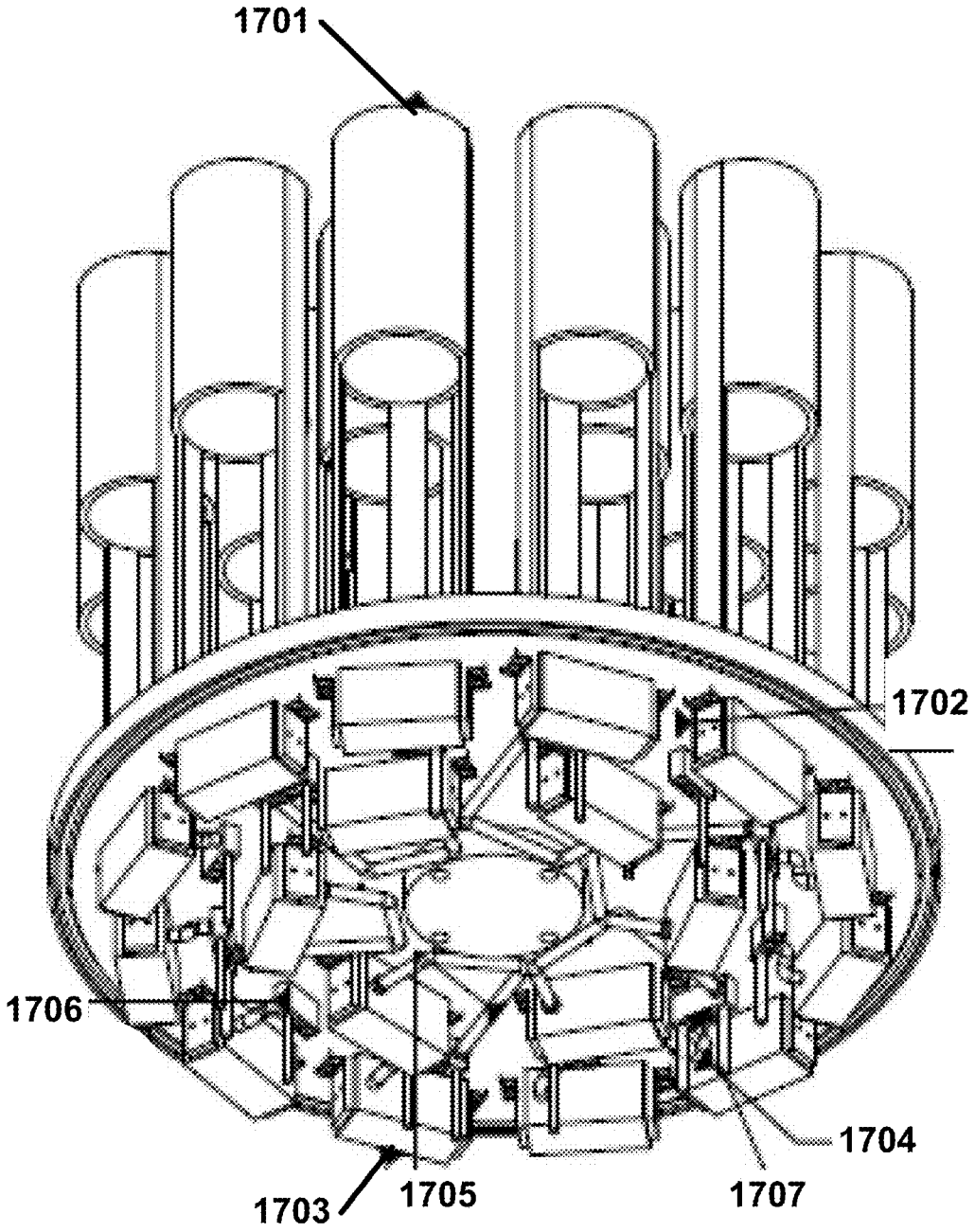
FIG. 17 is an illustration of aspects of various embodiment of the present invention.

FIG. 17 illustrates an example assembled view of various embodiments for mixing multiple fluids. A rotating liquid dispersing apparatus may comprise: mounts 1701 in which bottles of liquid may be secured, a rod 1702 configured to break the seal of bottles as they are inserted into the mechanism; a pump 1703 for each bottle of liquid; a flow measuring device 1704 attached configured to ensure that liquid measurements are accurate; and a tube 1705 running from the pump to the nozzle. This example embodiment demonstrates two types of nozzle mounts: a single nozzle mount 1706 and a dual nozzle mount 1707. Other nozzle mounts may be employed.

Figure 18:
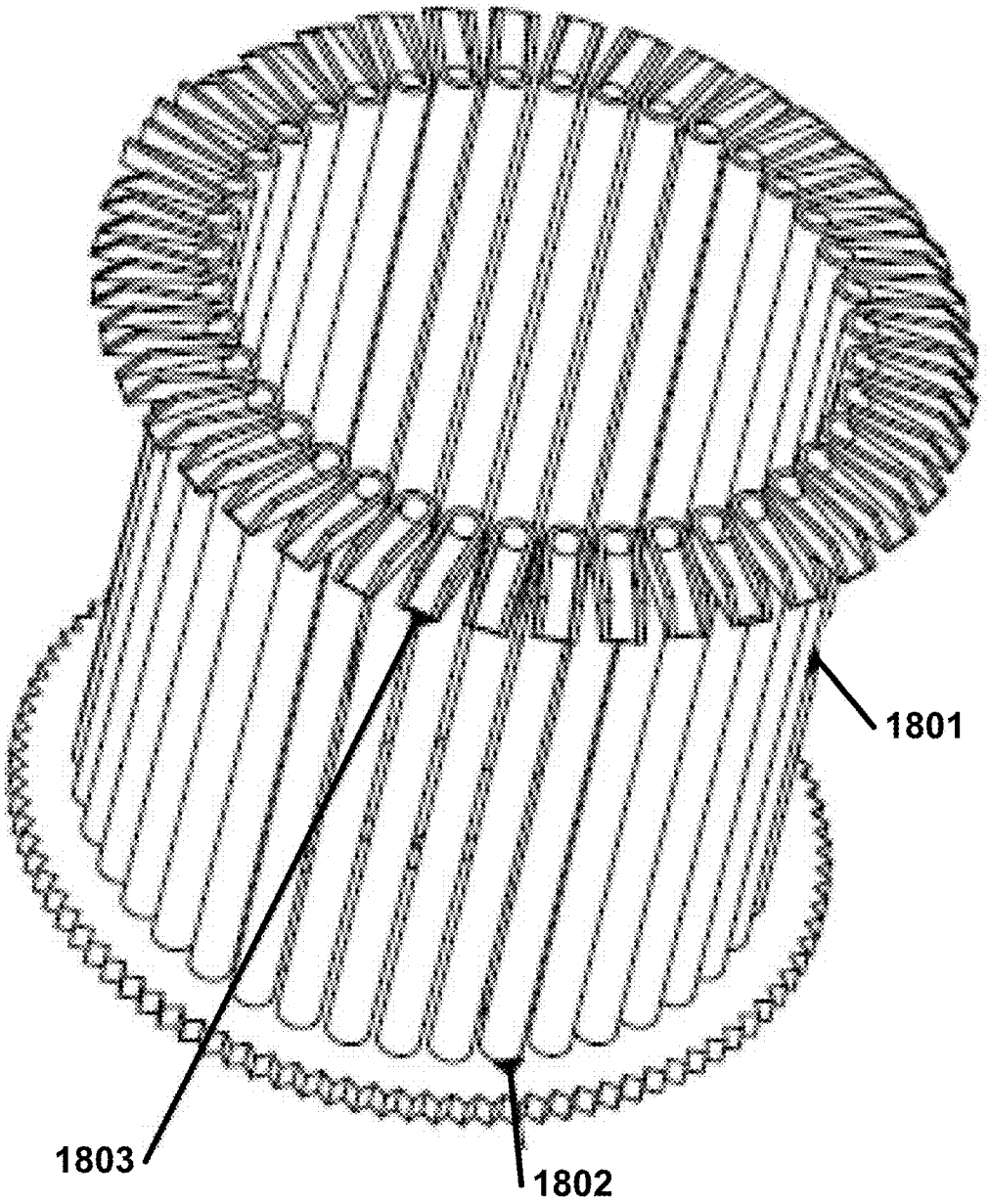
FIG. 18 is an illustration of aspects of various embodiment of the present invention.

FIG. 18 illustrates an example assembled view of various embodiments required for storing, filling and dispensing containers. A rotating container dispensing apparatus may comprise: a cylinder 1801 in which containers may be stored; an actuator 1802 in tube(s) configured to push containers up for filling and release to the user; and a channel 1803 configured to dispense containers. Channel 1803 may employ gravity to ensure that container(s) reach a receiving point.

Figure 19:
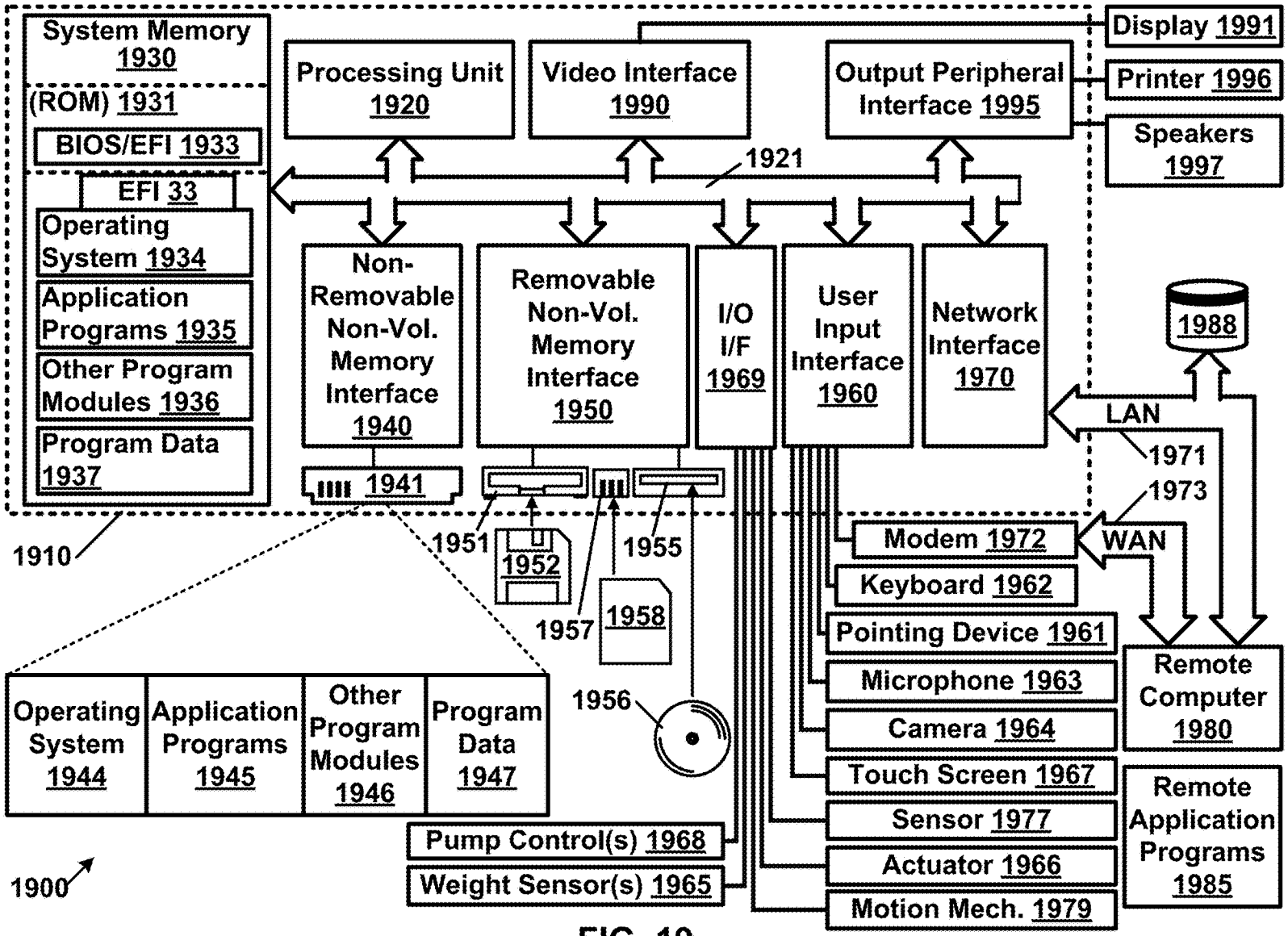
FIG. 19 illustrates a computing system environment on which aspects of some embodiments may be implemented.

FIG. 19 illustrates an example of a computing system environment 1900 on which aspects of some embodiments may be implemented. The computing system environment 1900 is only one example of a computing environment and is not intended to suggest any limitation as to the scope of use or functionality of the claimed subject matter. Neither should the computing environment 1900 be interpreted as having any dependency or requirement relating to any one or combination of components illustrated in the example operating environment 1900.

Embodiments are operational with numerous other general purpose or special purpose computing system environments or configurations. Examples of well-known computing systems, environments, and/or configurations that may be suitable for use with various embodiments include, but are not limited to, embedded computing systems, personal computers, server computers, mobile devices, hand-held or laptop devices, multiprocessor systems, microprocessor-based systems, set top boxes, programmable consumer electronics, medical device, network PCs, minicomputers, mainframe computers, cloud services, telephonic systems, distributed computing environments that include any of the above systems or devices, and the like.

Embodiments may be described in the general context of computer-executable instructions, such as program modules, being executed by computing capable devices. Generally, program modules include routines, programs, objects, components, data structures, etc. that perform particular tasks or implement particular abstract data types. Some embodiments may be designed to be practiced in distributed computing environments where tasks are performed by remote processing devices that are linked through a communications network. In a distributed computing environment, program modules may be located in both local and remote computer storage media including memory storage devices.

With reference to FIG. 19, an example system for implementing some embodiments includes a computing device 1910. The computing system may be employed as part of the point of sale module, the controller modules, other input/output apparatus modules, combinations thereof, and/or the like. Components of computer 1910 may include, but are not limited to, a processing unit 1920, a system memory 1930, and a system bus 1921 that couples various system components including the system memory to the processing unit 1920.

Computing device 1910 may comprise a variety of computer readable media. Computer readable media may be any available media that can be accessed by computing device 1910 and includes both volatile and nonvolatile media, and removable and non-removable media. By way of example, and not limitation, computer readable media may comprise computer storage media and communication media. Computer storage media may comprise volatile and/or nonvolatile, and/or removable and/or non-removable media implemented in any method or technology for storage of information such as computer readable instructions, data structures, program modules or other data. Computer storage media comprises, but is not limited to, random access memory (RAM), read-only memory (ROM), electrically erasable programmable read-only memory (EEPROM), flash memory or other memory technology, compact disc read-only memory (CD-ROM), digital versatile disks (DVD) or other optical disk storage, magnetic cassettes, magnetic tape, magnetic disk storage or other magnetic storage devices, or any other medium which can be used to store the desired information and which can be accessed by computer 1910. Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, radio frequency (RF), infrared and other wireless media configured to communicate modulated data signal(s). Combinations of any of the above should also be included within the scope of computer readable media.

The system memory 1930 includes computer storage media in the form of volatile and/or nonvolatile memory such as ROM 1931 and RAM 1932. A basic input/output system 1933 (BIOS) and/or extensible Firmware Interface (EFI) 1233, containing the basic routines that help to transfer information between elements within computer 1910, such as during start-up, is typically stored in ROM 1931. RAM 1932 typically contains data and/or program modules that are immediately accessible to and/or presently being operated on by processing unit 1920. By way of example, and not limitation, FIG. 19 illustrates operating system 1934, application programs 1935, other program modules 1936, and program data 1937 that may be stored in RAM 1932.

Computer 1910 may also include other removable/non-removable volatile/nonvolatile computer storage media. By way of example only, FIG. 19 illustrates a hard disk drive 1941 that reads from or writes to non-removable, nonvolatile magnetic media, a magnetic disk drive 1951 that reads from or writes to a removable, nonvolatile magnetic disk 1952, a flash drive reader 1957 that reads flash drive 1958, and an optical disk drive 1955 that reads from or writes to a removable, nonvolatile optical disk 1956 such as a Compact Disc Read Only Memory (CD ROM), Digital Versatile Disc (DVD), Blue-ray Disc™ (BD) or other optical media. Other removable/non-removable, volatile/nonvolatile computer storage media that can be used in the example operating environment include, but are not limited to, magnetic tape cassettes, flash memory cards, digital versatile disks, digital video tape, solid state RAM, solid state ROM, and the like. The hard disk drive 1941 is typically connected to the system bus 1921 through a non-removable memory interface such as interface 1940, and magnetic disk drive 1951 and optical disk drive 1955 are typically connected to the system bus 1921 by a removable memory interface, such as interface 1950.

The drives and their associated computer storage media discussed above and illustrated in FIG. 19 provide storage of computer readable instructions, data structures, program modules and other data for the computer 1910. In FIG. 19, for example, hard disk drive 1941 is illustrated as storing operating system 1944, application programs 1945, program data 1947, and other program modules 1946. Additionally, for example, non-volatile memory may include instructions, for example, to discover and configure IT device(s); to create device neutral user interface command(s); combinations thereof, and/or the like.

A user may enter commands and information into the computer 1910 through input devices such as a keyboard 1962, a microphone 1963, a camera 1964, touch screen 1967, and a pointing device 1961, such as a mouse, trackball or touch pad. These and other input devices may be connected to the processing unit 1920 through a user input interface 1960 that is coupled to the system bus, but may be connected by other interface and bus structures, such as a parallel port, a game port and/or a universal serial bus (USB).

Sensors and actuators, such as pump control(s) 1968, weight sensor(s) 1965, sensor(s) 1977, actuator(s) 1966, motion mechanisms 1979, and/or the like may be connected to the system bus 1921 via an Input/Output Interface (I/O I/F) 1969. A monitor 1991 or other type of display device may also be connected to the system bus 1921 via an interface, such as a video interface 1990. Other devices, such as, for example, speakers 1997 and printer 1996 may be connected to the system via peripheral interface 1995.

The computer 1910 is operated in a networked environment using logical connections to one or more remote computers, such as a remote computer 1980. The remote computer 1980 may be a personal computer, a mobile device, a hand-held device, a server, a router, a network PC, a medical device, a peer device or other common network node, and typically includes many or all of the elements described above relative to the computer 1910. The logical connections depicted in FIG. 19 include a local area network (LAN) 1971 and a wide area network (WAN) 1973, but may also include other networks such as, for example, a cellular network. Such networking environments are commonplace in offices, enterprise-wide computer networks, intranets and the Internet.

When used in a LAN networking environment, the computer 1910 is connected to the LAN 1971 through a network interface or adapter 1970. When used in a WAN networking environment, the computer 1910 typically includes a modem 1972 or other means for establishing communications over the WAN 1973, such as the Internet. The modem 1972, which may be internal or external, may be connected to the system bus 1921 via the user input interface 1960, or other appropriate mechanism. The modem 1972 may be wired or wireless. Examples of wireless devices may comprise, but are limited to: Wi-Fi, Near-field Communication (NFC) and Bluetooth™. In a networked environment, program modules depicted relative to the computer 1910, or portions thereof, may be stored in the remote memory storage device 1988. By way of example, and not limitation, FIG. 19 illustrates remote application programs 1985 as residing on remote computer 1980. It will be appreciated that the network connections shown are exemplary and other means of establishing a communications link between the computers may be used. Additionally, for example, LAN 1971 and WAN 1973 may provide a network interface to communicate with other distributed infrastructure management device(s); with IT device(s); with users remotely accessing the User Input Interface 1960; combinations thereof, and/or the like.

In this specification, "a" and "an" and similar phrases are to be interpreted as "at least one" and "one or more." References to "an" embodiment in this disclosure are not necessarily to the same embodiment.

Embodiments of the invention have been described with reference to the accompanying drawings, wherein like parts may be designated by like reference numerals, and wherein the leftmost digit of each reference number refers to the drawing number of the figure in which the referenced part first appears. Some of the figure elements comprise a corner symbol in the upper corner. This corner symbol indicates that element(s) in the illustrated embodiment(s) being illustrated by that figures may comprise multiple versions of that element. The multiple versions are not necessarily identical and the embodiments are not to be interpreted as being limited by the number of the elements unless explicitly limited in the claims.

Many of the elements described in the disclosed embodiments may be implemented as modules. A module is defined here as an isolatable element that performs a defined function and has a defined interface to other elements. Some modules may comprise other modules. The modules described in this disclosure may be implemented in hardware, a combination of hardware and software, firmware, or a combination thereof, all of which are behaviorally equivalent. Hardware may include electrical components, mechanical components, chemical components, biological components, combinations thereof, and/or the like. For example, modules may be implemented using computer hardware in combination with software routine(s) written in a computer language (such as C, C++, Fortran, Java, Basic, Matlab or the like) or a modeling/simulation program such as Simulink, Stateflow, GNU Octave, or LabVIEW MathScript. Additionally, it may be possible to implement modules using physical hardware that incorporates discrete or programmable analog, digital and/or quantum hardware. Examples of programmable hardware include: computers, microcontrollers, microprocessors, application-specific integrated circuits (ASICs); field programmable gate arrays (FPGAs); and complex programmable logic devices (CPLDs). Computers, microcontrollers and microprocessors are programmed using languages such as assembly, C, C++ or the like. FPGAs, ASICs and CPLDs are often programmed using hardware description languages (HDL) such as VHSIC hardware description language (VHDL) or Verilog that configure connections between internal hardware modules with lesser functionality on a programmable device. Finally, it needs to be emphasized that the above mentioned technologies may be used in combination to achieve the result of a functional module.

The disclosure of this patent document incorporates material which is subject to copyright protection. The copyright owner has no objection to the facsimile reproduction by anyone of the patent document or the patent disclosure, as it appears in the Patent and Trademark Office patent file or records, for the limited purposes required by law, but otherwise reserves all copyright rights whatsoever.

While various embodiments have been described above, it should be understood that they have been presented by way of example, and not limitation. It will be apparent to persons skilled in the relevant art(s) that various changes in form and detail can be made therein without departing from the spirit and scope. In fact, after reading the above description, it will be apparent to one skilled in the relevant art(s) how to implement alternative embodiments. Thus, the present embodiments should not be limited by any of the above described exemplary embodiments. In particular, it should be noted that, for example purposes, the above explanation has focused on the example(s) of producing e-cigarettes in a vending apparatus. However, one skilled in the art will recognize that embodiments of the invention could be used for other applications such as producing mixed laboratory formulations and scents.

In addition, it should be understood that any figures that highlight any functionality and/or advantages, are presented for example purposes only. The disclosed architecture is sufficiently flexible and configurable, such that it may be utilized in ways other than that shown. For example, the steps listed in any flowchart may be re-ordered or only optionally used in some embodiments.

Further, the purpose of the Abstract of the Disclosure is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract of the Disclosure is not intended to be limiting as to the scope in any way.

Finally, it is the applicant's intent that only claims that include the express language "means for" or "step for" be interpreted under 35 U.S.C. 112, paragraph 6. Claims that do not expressly include the phrase "means for" or "step for" are not to be interpreted under 35 U.S.C. 112, paragraph 6.

What is claimed is:

1. An apparatus comprising:

a) at least one filling module, each of the at least one filling module comprising:

i) a machine container configured to hold at least one of a multitude of vaping liquids;

ii) a nozzle configured to dispense at least one of the multitude of vaping liquids to at least one user container; and iii) a measuring pump module configured to pump a measured amount of at least one of the multitude of vaping liquids from the machine container to the nozzle;

b) at least one user container holder configured to hold the at least one user container;

c) a positioning mechanism configured to align the at least one user container holder with respect to the at least one filling module; and d) a controller module configured to execute production instructions comprising mixing instructions for at least one identified vaping liquid from the multitude of vaping liquids by sequentially, for vaping liquid(s) referenced in the mixing instructions:

i) align, employing the positioning mechanism, the at least one user container holder with the at least one filling module containing the at least one identified vaping liquid; and ii) dispense, according to mixing instructions, a measured volume of the at least one identified vaping liquid from the at least one filling module containing the at least one identified vaping liquid;

e) a droplet dislodger proximate to the nozzle, wherein the droplet dislodger is configured to use at least one of a shaker or a vibrator; and f) a circular carousel;

wherein the positioning mechanism is disposed on the circular carousel and configured to align the at least one user container holder with respect to each of the at least one filling module by moving the at least one user container holder rotationally around the circular carousel.

2. The apparatus of claim 1, further comprising at least one machine container fluid quantity sensor mounted proximate to the machine container.

3. The apparatus of claim 1, further comprising at least one user container fluid quantity sensor mounted proximate to the at least one user container.

4. The apparatus of claim 1, wherein the controller module is further configured to measure the volume of the at least one identified vaping liquid employing at least one of:

a) an external sensor;

b) an internal sensor;

c) a scale;

d) a flow sensor;
e) a level sensor; or
f) a combination of the above.

5. The apparatus according to claim 1, wherein the controller module is further configured to operate the measuring pump module based, at least in part, on a measured volume of at least one of the multitude of vaping liquids.

6. An apparatus comprising:
a) a circular carousel;
b) a plurality of filling modules each corresponding to a distinct vaping liquid of a plurality of vaping liquids and each comprising:
i) a machine container configured to hold the corresponding vaping liquid;
ii) a nozzle configured to dispense the corresponding vaping liquid to a user container; and
iii) a measuring pump module configured to pump a measured amount of the corresponding vaping liquid from the machine container to the nozzle;
c) a user container holder configured to hold the user container;
d) a positioning mechanism disposed on the circular carousel and configured to align the user container holder with respect to each of the plurality of filling modules by moving the user container holder rotationally around the circular carousel; and
e) a controller module configured to, for each of one or more vaping liquids, of the plurality of vaping liquids, referenced in a set of mixing instructions:
i) align, via the positioning mechanism, the user container holder with the filling module corresponding to the referenced vaping liquid; and
ii) dispense, according to the set of mixing instructions, a measured volume of the referenced vaping liquid from the corresponding filling module.

7. The apparatus of claim 6, wherein the set of mixing instructions comprises:
the one or more referenced vaping liquids as a selection of the plurality of vaping liquids with corresponding amounts;
wherein the measured volume dispensed by the controller is based at least in part on the amount corresponding to the referenced vaping liquid.

8. The apparatus of claim 6, wherein:
the circular carousel is a multilevel carousel; and
the positioning mechanism is structured to move the user container holder between different levels of the multilevel carousel.

9. The apparatus of claim 1, further comprising a point of sale module configured to:
a) accept an order from a user;
b) receive payment from the user for the order; or
c) generate production instructions configured to fill the order.

10. The apparatus of claim 1, further comprising a capping module configured to seal the at least one user container;
wherein the positioning mechanism is further configured to align the at least one user container holder with the capping module.

11. The apparatus of claim 1, further comprising a labeling module configured to apply at least one label to the at least one user container;
wherein the positioning mechanism is further configured to align the at least one user container holder with the labeling module.

12. The apparatus of claim 1, further comprising a mixing module configured to mix a contents of the at least one user container;
wherein the positioning mechanism is further configured to align the at least one user container holder with the mixing module.

13. The apparatus of claim 1, further comprising a point of sale module configured to generate mixing instructions from a formula comprising at least one mixing ratio of at least two of the multitude of vaping liquids.

14. The apparatus of claim 1, wherein the mixing instructions comprise a list comprising a quantity value for each of at least one identified vaping liquid.

15. The apparatus of claim 1, wherein at least one of the multitude of vaping liquids comprises at least two of:
a) propylene glycol;
b) glycerin;
c) water;
d) nicotine;
e) flavorings; or
f) a combination of the above.

16. The apparatus of claim 1, wherein the machine container comprises at least one of:
a) a bag;
b) a bottle;
c) a box;
d) a jar; or
e) a combination of the above.

17. The apparatus of claim 1, further comprising a machine container sensor that is:
a) communicatively connected to the controller module; and
b) configured to read a machine readable machine container identifier proximate to the machine container of at least one of the at least one filling module.

18. The apparatus of claim 1, wherein the machine container is configured to be interchangeable.

19. The apparatus of claim 1, wherein the measuring pump module comprises at least one of:
a) a peristaltic pump;
b) a syringe pump;
c) a valve pump;
d) a piston pump;
e) a positive displacement pump;
f) a gear pump; or
g) a combination of the above.

20. The apparatus of claim 1, wherein the measuring pump module comprises:
a) two pinch valves; and
b) one tubing depressor.

21. The apparatus of claim 1 further comprising an engagement mechanism configured to connect the measuring pump module to an external actuator.

22. The apparatus of claim 1, wherein the measuring pump module is further configured to pump vaping liquids in increments of 10 to 100 microliters.

23. The apparatus of claim 1, wherein the at least one user container holder is configured to hold at least one of:
a) an e-cigarette;
b) a personal vaporizer;
c) a vaping liquid tank;
d) a bottle configured to fill one of the above; or
e) a combination of the above.

24. The apparatus of claim 1, wherein the positioning mechanism comprises at least one of:
a) a rotary positioning mechanism;
b) a robotic manipulating mechanism;

c) a linear positioning mechanism;

d) a multilevel positioning mechanism; or e) a combination of the above.

25. The apparatus of claim 6, further comprising a point of sale module configured to:

a) accept an order from a user;

b) receive payment from the user for the order; or c) generate production instructions configured to fill the order.

26. The apparatus of claim 6, further comprising a capping module configured to seal the user container;

wherein the positioning mechanism is further configured to align the user container holder with the capping module.

27. The apparatus of claim 6, further comprising a labeling module configured to apply at least one label to the user container;

wherein the positioning mechanism is further configured to align the user container holder with the labeling module.

28. The apparatus of claim 6, further comprising a mixing module configured to mix a contents of the user container;

wherein the positioning mechanism is further configured to align the user container holder with the mixing module.

29. The apparatus of claim 6, further comprising a point of sale module configured to generate mixing instructions from a formula comprising at least one mixing ratio of at least two of the plurality of vaping liquids.

30. The apparatus of claim 6, wherein the set of mixing instructions comprise a list comprising a quantity value for each of at least one identified vaping liquid.

31. The apparatus of claim 6, further comprising a machine container sensor that is:

a) communicatively connected to the controller module; and b) configured to read a machine readable machine container identifier proximate to the machine container of at least one of the plurality of filing modules.

32. The apparatus of claim 6, wherein the machine container is configured to be interchangeable.

* * * * *